US008977542B2

(12) United States Patent
Norvell et al.

(10) Patent No.: US 8,977,542 B2
(45) Date of Patent: Mar. 10, 2015

(54) AUDIO ENCODER AND DECODER AND METHODS FOR ENCODING AND DECODING AN AUDIO SIGNAL

(75) Inventors: Erik Norvell, Stockholm (SE); Stefan Bruhn, Sollentuna (SE); Harald Pobloth, Täby (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 273 days.

(21) Appl. No.: 13/808,428

(22) PCT Filed: Jul. 16, 2010

(86) PCT No.: PCT/SE2010/050852

§ 371 (c)(1),
(2), (4) Date: Jan. 4, 2013

(87) PCT Pub. No.: WO2012/008891

PCT Pub. Date: Jan. 19, 2012

(65) Prior Publication Data

US 2013/0110506 A1 May 2, 2013

(51) Int. Cl.

| | |
|---|---|
| ***G10L 19/13*** | (2013.01) |
| ***G10L 19/038*** | (2013.01) |
| ***G10L 19/06*** | (2013.01) |

(Continued)

(52) U.S. Cl.

CPC ..... *G10L 19/13* (2013.01); *G10L 19/038* (2013.01); *G10L 19/06* (2013.01); *G10L 19/12* (2013.01); *G10L 2019/0002* (2013.01); *G10L 2019/0005* (2013.01)

USPC ..... 704/205

(58) Field of Classification Search

CPC ..... G10L 19/13
USPC ..... 704/205
See application file for complete search history.

(56) References Cited

U.S. PATENT DOCUMENTS

| | | | |
|---|---|---|---|
| 5,495,555 | A | 2/1996 | Swaminathan |
| 5,553,191 | A | 9/1996 | Minde |

(Continued)

FOREIGN PATENT DOCUMENTS

| | | | |
|---|---|---|---|
| CN | 101533639 | A | 9/2009 |
| EP | 0497479 | A1 | 8/1992 |
| WO | 0016315 | A2 | 3/2000 |

OTHER PUBLICATIONS

Valin, J-M., "A High-Quality Speech and Audio Codec With Less Than 10-ms Delay", IEEE Transactions on Audio, Speech, and Language Processing, Jan. 2010, pp. 58-67, vol. 18, No. 1, New York, NY.

(Continued)

*Primary Examiner* — Susan McFadden
(74) *Attorney, Agent, or Firm* — Coats & Bennett, PLLC

(57) ABSTRACT

The present invention relates to a frequency domain based method of encoding and decoding an audio signal, wherein an adaptive spectral code book is updated with synthesized frequency domain representations of a time domain signal segment. A frequency analysis is performed of a received time domain signal segment in order to obtain a frequency domain representation, and the adaptive spectral code book is searched for a first approximation of the frequency domain representation. A fixed spectral code book is searched for an approximation of the residual frequency representation. A synthesized frequency domain representation may be generated from the two approximations.

48 Claims, 13 Drawing Sheets

(51) Int. Cl.
*G10L 19/12* (2013.01)
*G10L 19/00* (2013.01)

(56) References Cited

U.S. PATENT DOCUMENTS

| | | | |
|---|---|---|---|
| 6,018,706 | A | 1/2000 | Huang et al. |
| 6,058,359 | A | 5/2000 | Hagen et al. |
| 2006/0282263 | A1 | 12/2006 | Vos et al. |
| 2007/0016412 | A1 | 1/2007 | Mehrotra et al. |

OTHER PUBLICATIONS

Preuss, R., et al., "Noise Robust Vocoding at 2400 bps", IEEE 8th International Conference on Signal Processing, Jan. 2006.

Hernandez-Gomez, L., et al., "Short-Time Synthesis Procedures in Vector Adaptive Transform Coding of Speech", ETSI, May 23, 1989, pp. 762-765.

Sperschneider, Ralph; "Text of ISO/IEC13818-7:2005(MPEG-2 AAC 4th Edition)"; Coding of Moving Pictures and Audio; ISO/IEC JTC1/SC29/WG11; N7126; Apr. 2005; pp. 1-181; International Organization for Standartisation; Busan, KR.

Ojanperä, Juha et al; "Long Term Predictor for Transform Domain Perceptual Audio Coding"; 5036 (K-4); Sep. 24-27, 1999; pp. 1-26; Audio Engineering Society, 60 East 42nd St., New York, NY 10165-2520, USA.

Bhaskar, U. et al; "Quantization of SEW and REW Components for 3.6 Kbit/s Coding Based on PWI"; IEEE Workshop on Speech Coding Proceedings. Model, Coders, and Error Criteria (Cat No. 99EX351); Jun. 20-23, 1999; pp. 99-101; Porvoo, Finland.

Lefebvre, R. et al; High Quality Coding of Wideband Audio Signals Using Transform Coded Excitation (TCX); Acoustics, Speech, and Signal Processing, 1994. ICASSP-94., 1994 IEEE International Conference on; Apr. 19-22, 1994; pp. I/193-I/196; vol. I; 0-7803-1775-0; Adelaide, SA.

3rd Generation Partnership Project 2; "Enhanced Variable Rate Codec, Speech Service Option 3 and 68 for Wideband Spread Spectrum Digital Systems"; 3GPP2 C.S0014-B Version 1.0; pp. 1-282; May 2006; 3GPP2, 2500 Wilson Boulevard, Suite 300, Arlington, Virginia USA.

Hagen, Roar et al; "An 8 Kbit/s ACELP Coder With Improved Background Noise Performance"; ICASSP '99 Proceedings of the Acoustics, Speech, and Signal Processing, 1999. on 1999 IEEE International Conference; pp. 25-28; vol. 01; IEEE Computer Society, Washington, DC, USA.

100

AUDIO ENCODER AND DECODER AND METHODS FOR ENCODING AND DECODING AN AUDIO SIGNAL

TECHNICAL FIELD

The present invention relates to the field of audio signal encoding and decoding.

BACKGROUND

A mobile communications system presents a challenging environment for voice transmission services. A voice call can take place virtually anywhere, and the surrounding background noises and acoustic conditions will have an impact on the quality and intelligibility of the transmitted speech. At the same time, there is strong motivation for limiting the transmission resources consumed by each communication device. Mobile communications services therefore employ compression technologies in order to reduce the transmission bandwidth consumed by the voice signals. Lower bandwidth consumption yields lower power consumption in both the mobile device and the base station. This translates to energy and cost saving for the mobile operator, while the end user will experience prolonged battery life and increased talk-time. Furthermore, with less consumed bandwidth per user, a mobile network can service a larger number of users at the same time.

Today, the dominating compression technology for mobile voice services is Code Excited Linear Prediction (CELP), described for example in "Code-Excited Linear Prediction (CELP) high-quality speech at very low bit rates", M. R. Schroeder and B. Atal, IEEE ICASSP 1985.

CELP is an encoding method operating according to an analysis-by-synthesis procedure. In CELP for voice coding, linear prediction analysis is used in order to determine, based on an audio signal to be encoded, a slowly varying linear prediction (LP) filter A(z) representing the human vocal tract. The audio signal is divided into signal segments, and a signal segment is filtered using the determined A(z), the filtering resulting in a filtered signal segment, often referred to as the LP residual. A target signal x(n) is then formed, typically by filtering the LP residual through a weighted synthesis filter W(z)/Â(z) to form a target signal x(n) in the weighted domain. The target signal x(n) is used as a reference signal for an analysis-by-synthesis procedure wherein an adaptive code book is searched for a sequence of past excitation samples which, when filtered through weighted synthesis filter, would give a good approximation of the target signal. A secondary target signal $x_2(n)$ is then derived by subtracting the selected adaptive code book signal from the filtered signal segment. The secondary target signal is in turn used as a reference signal for a further analysis-by-synthesis procedure, wherein a fixed code book is searched for a vector of pulses which, when filtered through the weighted synthesis filter, would give a good approximation of the secondary target signal. The adaptive code book is then updated with a linear combination of the selected adaptive code book vector and the selected fixed code book vector.

By use of CELP, a good speech quality at moderately low bandwidth is typically achieved, and the method is widely used in deployed codecs such as GSM-EFR, AMR and AMR-WB. However, for the very low bit rates, the limitations of the CELP coding technique begin to show. While the segments of voiced speech remain well represented, the more noise-like consonants such as fricatives start to sound worse. Degradation can also be perceived in the background noises.

As seen above, the CELP technique uses a pulse based excitation signal. For voiced signal segments, the filtered signal segment (target excitation signal) is concentrated around so called glottal pulses, occurring at regular intervals corresponding to the fundamental frequency of the speech segment. This structure can be well modeled with a vector of pulses. For a noise-like segment, on the other hand, the target excitation signal is less structured in the sense that the energy is more spread over the entire vector. Such an energy distribution is not well captured with a vector of pulses, and particularly not at low bitrates. When the bit rate is low, the pulses simply become too few to adequately capture the energy distribution of the noise-like signals, and the resulting synthesized speech will have a buzzing distortion, often referred to as the sparseness artefact of CELP codecs.

Hence, for the very low bit rates, which could for example be advantageous when the transmission channel conditions are poor, an alternative to the CELP is required in order to arrive at a well sounding synthesized signal. Several technologies have been developed in order to deal with the CELP sparseness artefact at low bitrates. WO99/12156 discloses a method of decoding an encoded signal, wherein an anti-sparseness filter is applied as a post-processing step in the decoding of the speech signal. Such anti-sparseness processing reduces the sparseness artefact, but the end result can still sound a bit unnatural.

Another method of mitigating the sparseness artefact which is well known in the art is often referred to as Noise Excited Linear Prediction (NELP). In NELP, signal segments are processed using a noise signal as the excitation signal. The noise excitation is only suitable for representation of noise-like sounds. Therefore, a system using NELP often uses a different excitation method, e.g. CELP, for the tonal or voiced segments. Thus, the NELP technology relies on a classification of the speech segment, using different encoding strategies for unvoiced and voiced parts of an audio signal. The difference between these coding strategies gives rise to switching artefacts upon switching between the voiced and unvoiced switching strategies. Furthermore, the noise excitation will typically not be able to successfully model the excitation of complex noise-like signals, and parts of the anti-sparseness artefacts will therefore typically remain.

As can be seen from the above, there is a need for an improved codec by which a high quality synthesized audio signal can be obtained even when the encoded signal is encoded for low bit rate transmission.

SUMMARY

An object of the present invention relates is to improve the quality of a synthesized audio signal when the encoded signal is transmitted at a low bit rate.

This object is addressed by an encoding method, a decoding method, an audio encoder, an audio decoder, and computer programs for encoding and decoding of an audio signal.

A method of encoding and decoding an audio signal is provided, wherein an adaptive spectral code book of an encoder, as well as of a decoder, is updated with frequency domain representations of encoded time domain signal segments. A received time domain signal segment is analysed by an encoder to yield a frequency domain representation, and an adaptive spectral code book in the encoder is searched for an ASCB vector which provides a first approximation of the obtained frequency domain representation. This ASCB vector is selected. A residual frequency representation is generated from the difference between the frequency domain representation and the selected ASCB vector. A fixed spectral code book in the encoder is then searched for an FSCB vector which provides an approximation of the residual frequency representation. This FSCB vector is also selected. A synthesized frequency representation may be generated from the two selected vectors. The encoder further generates a signal representation indicative of an index referring to the selected ASCB vector, and of an index referring to the selected FSCB vector. The gains of the linear combination can advantageously also be indicated in the signal representation.

A signal representation generated by an encoder as discussed above, can be decoded by identifying, using the ASCB index and FSCB index retrieved from the signal representation, an ASCB vector and an FSCB vector. In decoding of the signal representation, a linear combination of the identified ASCB vector and the identified FSCB vector provides a synthesized frequency domain representation of the time domain signal segment to be synthesized. A synthesized time domain signal is generated from the synthesized frequency domain representation.

By using a frequency domain representation of a time domain signal segment in the encoding of an audio signal, control of the spectral distribution of noise-like sounds can efficiently be obtained also at low bitrates, and the synthesis of such sounds can thereby be improved when the transmission channel between the encoder and decoder provides a low bitrate. Since the length of the time domain signal segments considered for encoding of speech signals is relatively short, the corresponding frequency domain representation will likely show large variations between time-adjacent frames. By providing an adaptive spectral code book which is frequently updated, it is ensured that a suitable approximation of the frequency domain representation can be found, despite the anticipated poor correlation between time-adjacent frequency domain representations of time domain signal segments.

In one embodiment, the frequency domain representation is obtained by performing a time-to-frequency domain transformation analysis of a time domain signal segment, thereby obtaining a segment spectrum. The frequency domain representation is obtained as at least a part of the segment spectrum. The time-to-frequency domain transform could for example be a Discrete Fourier Transform (DFT), where the obtained segment spectrum comprises a magnitude spectrum and a phase spectrum. The frequency domain representation could then correspond to the magnitude spectrum part of the segment spectrum. Another example of a time-to-frequency domain transform analysis is the Modified Discrete Cosine Transform analysis (MDCT), which generates a single real-valued MDCT spectrum. In this case, the frequency domain representation could correspond to the MDCT spectrum. Other analyses may alternatively be used. In another embodiment, the frequency domain representation is obtained by performing a linear prediction analysis of a time domain signal segment.

In one embodiment, the encoding/decoding method applied to a time domain signal segment is dependent on the phase sensitivity of the sound information carried by the segment. In this embodiment, an indication of whether a segment should be treated as phase insensitive or phase sensitive could be sent to the decoder, for example as part of the signal representation. For a segment which carries phase insensitive information, the generation of a synthesized time domain signal from the synthesized frequency domain representation could include a random component, which could advantageously be generated in the decoder. For example, when the frequency analysis performed in the encoder is a DFT, the phase spectrum could be randomly generated in the decoder; or when the frequency analysis is an LP analysis, a time domain excitation signal could be randomly generated in the decoder. For the encoding of a segment carrying phase sensitive information, a time domain based encoding method, such as CELP, would be used. Alternatively, a frequency domain based encoding method using an adaptive spectral code book could be used also for encoding of phase sensitive signal segments, where the signal representation includes more information for phase sensitive signal segments than for phase insensitive. For example, if some information is randomly generated in the decoder for phase insensitive segments, at least part of such information can, for phase sensitive segments, instead be parameterized by the encoder and conveyed to the decoder as part of the signal representation.

By using different encoding/decoding methods for different types of sounds, the bandwidth requirements for the transmission of the signal representation can be kept low, while allowing for the noise like sounds to be encoded by means of a frequency domain based encoding method using an adaptive spectral code book.

Randomly generated information, such as the phase of a segment spectrum or a time domain excitation signal, could in one embodiment be used for all signal segments, regardless of phase sensitivity.

When the frequency analysis is a DFT and a randomly generated phase spectrum is used in the decoding of a segment, the sign of the DC component of the random spectrum can for example be adjusted according to the sign of the DC component of the segment spectrum, thereby improving the stability of the energy evolution between adjacent segments. Hence, the sign of the DC component of the segment spectrum can be included in the signal representation. By using randomly generated phase information when synthesizing the segment spectrum, the amount of phase information that has to be transmitted from the encoder to the decoder can be greatly reduced or, in some embodiments, even eliminated.

The encoding method may, in one embodiment, include an estimate of the quality of the first approximation of the frequency domain representation. If such quality estimation indicates the quality to be insufficient, the encoder could enter a fast convergence mode, wherein the frequency domain representation is approximated by at least two FSCB vectors, instead of one FSCB vector and one ASCB vector. This can be useful in situations where the audio signal to be encoded changes rapidly, or immediately after the adaptive spectral code book has been initiated, since the ASCB vectors stored in the adaptive spectral code book may then be less suitable for approximating the frequency domain representation. The fast convergence mode can be signaled to the decoder, for example as part of the signal representation. The adaptive spectral code book of the encoder and of the decoder can advantageously be updated also in the fast convergence mode.

The updating of the adaptive spectral code book of the encoder and of the decoder can be conditional on a relevance indicator exceeding a relevance threshold, the relevance indicator providing a value of the relevance of a particular frequency domain representation for the encodability of future time domain signal segments. The global gain of a segment could for example be used as a relevance indicator. In the decoder, the value of the relevance indicator could in one implementation be determined by the decoder itself, or a value of the relevance indicator could be received from the encoder, for example as part of the signal representation.

Further aspects of the invention are set out in the following detailed description and in the accompanying claims.

DETAILED DESCRIPTION

Figure 1:
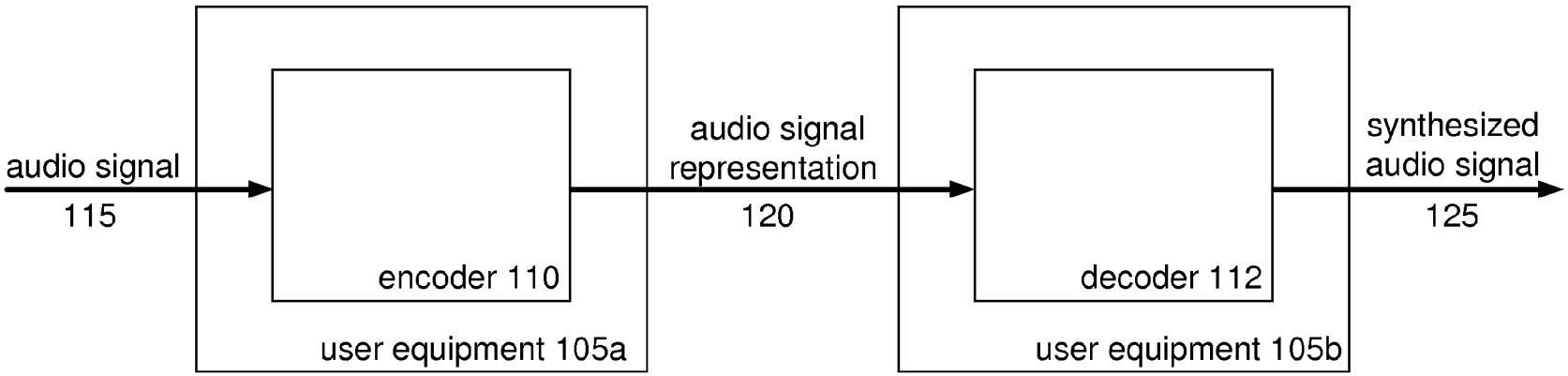
FIG. 1 is a schematic illustration of an audio codec system comprising an encoder and a decoder.

FIG. 1 schematically illustrates a codec system 100 including a first user equipment 105*a* having an encoding 110, as well as a second user equipment 105*b* having a decoder 112. A user equipment 105*a/b* could, in some implementations, include both an encoder 110 and a decoder 112. When generally referring to any user equipment, the reference numeral 105 will be used.

The encoder 110 is configured to receive an input audio signal 115 and to encode the input signal 115 into a compressed audio signal representation 120. The decoder 112, on the other hand, is configured to receive an audio signal representation 120, and to decode the audio signal representation 120 into a synthesized audio signal 125, which hence is a re-production of to the input audio signal 115. The input audio signal 115 is typically divided into a sequence of input signal segments, either by the encoder 110 or by further equipment prior to the signal arriving at the encoder 110, and the encoding/decoding performed by the encoder 110/decoder 112 is typically performed on a segment-by-segment basis. Two consecutive signal segments may have a time overlap, so that some signal information is carried in both signal segments, or alternatively, two consecutive signal segments may represent two distinctly different, and typically adjacent, time periods. A signal segment could for example be a signal frame, a sequence of more than one signal frames, or part of a signal frame.

According to the invention, the effects of sparseness artefacts at low bitrates discussed above in relation to the CELP encoding technique can be avoided by using an encoding/decoding technique wherein an input audio signal is transformed, from the time domain, into the frequency domain, so that a signal spectrum is generated. By introducing the possibility of directly controlling the spectral energy distribution of a signal segment, the noise-like signal segments can be more accurately reproduced even at low bitrates. A signal segment which carries information which is aperiodic can be considered noise-like. Examples of such signal segments are signal segments carrying fricative sounds and noise-like background noises.

Transforming an input audio signal into the frequency domain as part of the encoding process is know from e.g. WO95/28699 and "*High Quality Coding of Wideband Audio Signals using Transform Coded Excitation* (*TCX*)", R. Lefebvre et al., *ICASSP* 1994, pp. I/193-I/196 vol. 1. The method disclosed in these publications, referred to as TCX and wherein an input audio signal is transformed into a signal spectrum in the frequency domain, was proposed as an alternative to CELP at high bitrates where CELP requires high processing power—the computation requirement of CELP increases exponentially with bitrate.

In the TCX encoding method of R. Lefebvre et al, a prediction of the signal spectrum is given by the previous signal spectrum, obtained from transforming the previous signal segment. A prediction residual is then obtained as the difference between the prediction of the signal spectrum and the signal spectrum itself. A spectral prediction residual code book is then searched for a residual vector which provides a good approximation of the prediction residual.

The TCX method has been developed for the encoding of signals which require a high bitrate and wherein a high correlation exists in the spectral energy distribution between adjacent signal segments. An example of such signals is music. For signal segments representing noise-like sounds such as fricatives, on the other hand, the spectral energy distribution of adjacent signal segments are generally less correlated when using segment lengths typical for voice encoding (where e.g. 5 ms is an often used duration of a voice encoding signal segment). A longer signal segment time duration is often not appropriate, since a longer time window will reduce the time resolution and possibly have a smearing effect on noise-like transient sounds.

According to the invention, control of the spectral distribution of noise-like sounds can, however, be obtained by using an encoding/decoding technique wherein a time domain signal segment originating from an audio signal is transformed into the frequency domain, so that a segment spectrum is generated, and wherein an adaptive spectral code book (ASCB) is used to search for a vector which can provide an approximation of the segment spectrum. The ASCB comprises a plurality of adaptive spectral code book vectors representing previously synthesized segment spectra, of which one, which will provide a first approximation of the segment spectrum, is selected. A residual spectrum, representing the difference between the segment spectrum and the first spectrum approximation, is then generated. A fixed spectral code book (FSCB) is then searched to identify and select a FSCB vector which can provide an approximation of the residual spectrum. The signal segment can then be synthesized by use of a linear combination of the selected ASCB vector and the selected FSCB vector. The ASCB is then updated by including a vector, representing the synthesized magnitude spectrum, in the set of spectral adaptive code book vectors.

By use of a time-vs-frequency domain transform in combination with an adaptive spectral code book for encoding an audio signal segment is achieved that an efficient encoding and decoding of audio signals can be obtained, wherein noise-like sounds are reproduced in a satisfying manner. Experimental studies show that, although adaptive code books in time domain are typically used to facilitate the encoding of strongly periodic signals, the encoding of noise-like signals, which are typically aperiodic, can be efficiently performed by use of an adaptive spectral code book. The time-vs-frequency domain transform facilitates for the accurate control of the spectral energy distribution of a signal segment, while the adaptive spectral code book ensures that a suitable approximation of the segment spectrum can be found, despite possible poor correlation between time-adjacent segment spectra of signal segments carrying the noise-like sounds.

Figure 2:
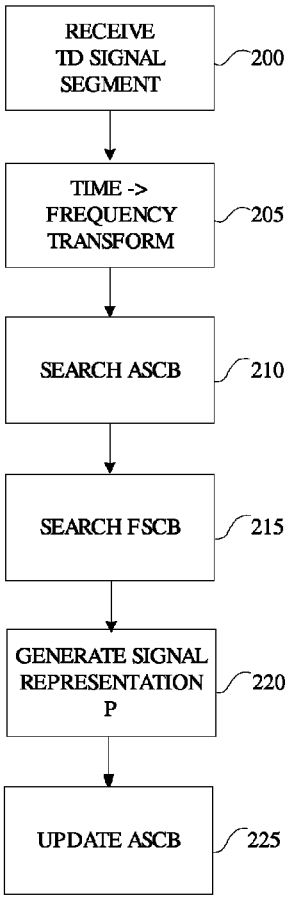
FIG. 2 is a flowchart illustrating a method of encoding an audio signal into a signal representation.

An encoding method according to an embodiment of the invention is shown in FIG. 2. The method shown in FIG. 2 will be referred as a transform based adaptive encoding method. At step 200, a time domain (TD) signal segment $\overline{T}^m$ comprising N samples is received at an encoder 110, where m indicates a segment number. In the following description of FIGS. 2 and 3, the encoding and decoding of a particular signal segment is described, and the segment number m will be omitted from the description. The TD signal segment $\overline{T}$ can for example be a segment of an audio signal 115, or the TD signal segment can be a quantized and pre-processed segment of an audio signal 115. Pre-processing of an audio signal can for example include filtering the audio signal 115 through a linear prediction filter, and/or perceptual weighting. In some implementations, the quantization, segmenting and/or any further pre-processing is performed in the encoder 110, or such signal processing could have been performed in further equipment to which an input of the encoder 110 is connected.

In step 205, a time-to-frequency transform is applied to the TD signal segment $\overline{T}$, so that a segment spectrum $\overline{S}$ is generated. The time-to-frequency transform could for example be a Discrete Fourier Transform (DFT), implemented e.g. as the Fast Fourier Transform:

$$S(k) = \sum_{n=0}^{N-1} T(n) e^{-\frac{j\pi nk}{N}}, \tag{1}$$

where T(n) is a TD signal segment sample, $n \in [0, 1, \ldots, N-1]$, and S(k) is the kth component of the complex DFT, $k \in [0, 1, \ldots, N-1]$ Other possible transforms that could alternatively be used in step 205 include the discrete cosine transform, the Hadamard transform, the Karhunen-Loëve transform, the Singular Value Decomposition (SVD) transform, Quadrature Mirror Filter (QMF) filter banks, etc. Such transform algorithms are known in the art, and will not be further described here.

Step 205 typically includes determining the magnitude spectrum $\overline{X}$:

$$X(k)=|S(k)|, k=0,1,2,3 \ldots M \tag{2}$$

where M=N/2+1 (assuming that N is even). If only the magnitude spectrum is required, it would hence be sufficient for k to run from k=0 to k=M, while if while if a full phase spectrum is desired, k would advantageously run from k=0 to k=N−1.

In step 210, the ASCB is searched for a vector which can provide a first approximation of the magnitude spectrum $\overline{X}$, and hence a first approximation of the segment spectrum $\overline{S}$. The ASCB can be seen as a matrix $\overline{C}_A$ having dimensions $N_{ASCB} \times M$ (or $M \times N_{ASCB}$), where $N_{ASCB}$ denotes the number of adaptive spectral code book vectors included in the ASCB, where a typical value of $N_{ASCB}$ could lie within the range [16,128] (other values of $N_{ASCB}$ could alternatively be used). Each row (or column) of the matrix $\overline{C}_A$ represents a synthesized magnitude spectrum of a previous segment, such that $C_{A,i,k}$ ($C_{A,k,i}$) denotes frequency bin $k \in [0, 1, \ldots, M-1]$ for segment m-i for i=1, 2, 3 . . . , $N_{ASCB}$, where m denotes the current segment. For ease of description, it will in the following be assumed that the previous synthesized spectra are represented by the rows, rather than the columns, of the ASCB matrix $\overline{C}_A$. Furthermore, it will for illustrative purposes be assumed that the rows of $\overline{C}_A$ are normalized, such that:

$$\sum_{k=0}^{M-1} C_{A,i,k}^2 = 1,\ i = 1, 2, 3 \ldots, N_{ASCB}$$

Normalization of the ASCB vectors stored in $\overline{C}_A$ will furthermore simplify the calculations.

The search of the ASCB performed in step 210 could for example include determining the row vector of $\overline{C}_A$ which yields the largest absolute magnitude correlation with the segment spectrum:

$$i_{ASCB} = \underset{i}{\operatorname{argmax}} \left( \sum_{k=0}^{M-1} C_{A,i,k} X(k) \right), \tag{3}$$

where $i_{ASCB}$ is an index identifying the selected ASCB vector. Expression (3) can be seen as if the ASCB vector which matches the segment spectrum in a minimum mean squared error sense is selected. Other ways of selecting the ASCB vector may be employed, such as e.g. selecting the ASCB vector which minimizes the average error over a fixed number of consecutive segments.

Once a row vector $\overline{C}_{A,i_{ASCB}}$ has been selected to provide an approximation of the magnitude spectrum $\overline{X}$, a gain parameter $g_{ASCB}$ can be determined, for example by use of the following expression:

$$g_{ASCB} = \sum_{k=0}^{M-1} C_{A,i_{ASCB},k} X(k). \tag{4}$$

A first approximation of the segment spectrum can be given as $g_{ASCB} \cdot \overline{C}_{A,i_{ASCB}}$. Since $\overline{C}_{A,i_{ASCB},k}$ and $\overline{X}$ are magnitude spectra, the gain $g_{ASCB}$ will always be positive.

Step 215 is then entered, wherein the FSCB is searched for an FSCB vector providing an approximation of the residual spectrum, here referred to a residual spectrum approximation. The residual spectrum $\overline{R}$ can for example be defined as:

$$R(k)=X(k)-g_{ASCB} C_{A,i_{ASCB},k}, k=0,1,2, \ldots, (M-1) \tag{5}$$

The FSCB can be seen as a matrix $\overline{C}_F$ having dimensions $N_{FSCB} \times M$ (or $M \times N_{FSCB}$), where $N_{FSCB}$ denotes the number of fixed spectral code book vectors included in the FSCB, where a typical value of $N_{FSCB}$ could lie within the range [16,128] (other values of $N_{FSCB}$ could alternatively be used). Each row (or column) of the matrix $\overline{C}_F$ represents a fixed differential spectrum, such that $C_{F,i,k}$ ($C_{F,k,i}$) denotes frequency bin k∈[0, 1, . . . , M−1] for entry number i=1, 2, 3 . . . , $N_{FSCB}$. For ease of description, it will in the following be assumed that the previous synthesized spectra are represented by the rows, rather than the columns, of the FSCB matrix $\overline{C}_F$.

The search of the FSCB performed in step 215 could for example include determining the row vector of $\overline{C}_F$ which yields the largest absolute magnitude correlation with the residual spectrum:

$$i_{FSCB} = \underset{i}{\operatorname{argmax}}\left(\sum_{k=0}^{M-1} C_{F,i,k} R(k)\right), \tag{6}$$

where $i_{FSCB}$ is an index identifying the selected FSCB vector to be used in providing the residual spectrum approximation.

Once a row vector $\overline{C}_{F,i_{FSCB}}$ has been selected to provide an approximation of the residual spectrum, a gain parameter $g_{FSCB}$ can be determined, for example by use of the following expression:

$$g_{FSCB} = \sum_{k=0}^{M-1} C_{F,i_{FSCB},k} R(k). \tag{7}$$

A residual spectrum approximation can be given as $g_{FSCB} \cdot \overline{C}_{F,i_{FSCB}}$.

A signal representation P of the signal segment is then generated in step 220, the signal representation P being indicative of the indices $i_{ASCB}$ and $i_{FSCB}$, as well as of the gains $g_{ASCB}$ and $g_{FSCB}$. The representations of $g_{ASCB}$ and $g_{FSCB}$ included in the representation P are typically quantized, and could for example correspond to the values of $g_{ASCB}$ & $g_{FSCB}$, or to the values of a global gain ratio $$g_{\propto} = \frac{g_{FSCB}}{g_{ASCB}}\left(\text{or } g_{\beta} = \frac{g_{ASCB}}{g_{FSCB}}\right),$$

where the global gain represents the global energy of the signal segment. By representing the gains by (quantized values of) $g_{\propto}$ and $g_{global}$, the balance between energy matching and waveform matching can more easily be controlled, as described below in relation to expression (19). In the following, no difference will be made in the notation of actual gain values and the quantized gain values. Signal representation P forms part of the audio signal representation 120.

Step 225 is then entered, wherein the ASCB is updated with a vector $\overline{Y}$, or a vector proportional to $\overline{Y}$, where $\overline{Y}$ is the synthesized magnitude spectrum obtained from a linear combination of the selected ASCB vector $\overline{C}_{A,i_{ASCB}}$ and the selected FSCB vector $\overline{C}_{F,i_{FSCB}}$:

$$Y'(k)=g_{ASCB}C_{A,i_{ASCB},k}+g_{FSCB}C_{F,i_{FSCB},k} \tag{8a}$$

In expression (8a), we assume that the synthesis is based on the gain parameter pair $g_{ASCB}$ & $g_{FSCB}$. As mentioned above, the synthesis may be based on the gain parameter pair $g_{global}$ and $g_{\alpha}$. The synthesized magnitude spectrum could then be expressed by:

$$Y'(k)=g_{global}(C_{A,i_{ASCB},k}+g_{\alpha}C_{F,i_{FSCB},k}) \tag{8b}$$

Since the residual spectrum approximation is obtained as a differential spectrum, the FSCB gain can take a negative value. Furthermore, it may be that a simple linear combination of $\overline{C}_{A,i_{ASCB}}$ and $\overline{C}_{F,i_{FSCB}}$ yields negative values of the spectral magnitude for some frequency bins k. Hence, in order to obtain a physically correct representation of the synthesized segment spectrum, any negative frequency bin magnitude values could be replaced by zero, so that:

$$Y(k) = \begin{cases} Y'(k), & Y'(k) \geq 0 \\ 0, & Y'(k) < 0 \end{cases} \tag{8c}$$

$$k = 0, 1, 2, \ldots (M-1).$$

Negative frequency bin magnitude values could alternatively be replaced by other positive values, such as |Y'|(k)|.

As will be seen below, it may in some implementations be beneficial to determine a pre-synthesis magnitude spectrum as:

$$Y_{pre}(k)=C_{A,i_{ASCB},k}+g_{\alpha}C_{F,i_{FSCB},k} \tag{8d}$$

Thus, the synthesized magnitude spectrum is determined in step 315 as $\overline{Y}/g_{global}$, and the scaling with $g_{global}$ is performed after the f-to-time transform. This is particularly useful if the synthesized TD signal segment is used for determining a suitable value of $g_{global}$ (cf. expression (19) and (20)).

As mentioned above, order to simplify the numerical calculations illustrated by expressions (3) and (4) above, the rows of $\overline{C}_A$ can advantageously be normalized such that:

$$\sum_{k=0}^{M-1} C_{A,i,k}^2 = 1, \tag{9}$$

$$i = 1, 2, 3 \ldots, N_{ASCB}.$$

In an implementation wherein the rows of $\overline{C}_A$ are normalized, the ASCB is hence updated with a normalized version of the magnitude spectrum $\overline{Y}$:

$$C_{A,U,k}:=Y_{normalised}(k)$$

where U denotes the row of ASCB to be updated, which typically is the row representing the oldest previous synthesized spectrum stored in the ASCB. An example of the updating procedure can be represented by first shifting the rows of the ASCB down one step such that:

$$C_{A,i,k}=C_{A,i-1,k}, i=N_{ASCB}, \ldots, 4,3,2 k=0,1,2, \ldots, (M-1), \tag{10a}$$

and then, the normalized synthesized spectrum magnitude is inserted in the first row:

$$C_{A,1,k} = \frac{Y(k)}{\sqrt{\sum_{j=0}^{M-1} Y^2(j)}}, \tag{10b}$$

$$k = 0, 1, 2, \ldots (M-1)$$

The ASCB could for example be implemented as a FIFO (First In First Out) buffer. From an implementation perspective, it is often advantageous to avoid the shifting operation of expressions (10a) & (10b), and instead move the insertion point for the current frame, using the ASCB as a circular buffer.

Prior to having received any TD signal segments $\overline{T}$ to be encoded, the ASCB is preferably initialized in a suitable manner, for example by setting the elements of the matrix $\overline{C}_A$ to random numbers, or by using a pre-defined set of vectors.

In one embodiment, here used as an example, the matrix $\overline{C}_A$ is initialized with a single constant value, corresponding to a set of flat spectra:

$$C_{A,i,k} = \frac{1}{\sqrt{M}}. \tag{11}$$

The FSCB could for example be represented by a pre-trained vector codebook, which has the same structure as the ASCB, although it is not dynamically updated. There are several options for constructing an FSCB. An FSCB could for example be composed of a fixed set of differential spectrum candidates stored as vectors, or it could be generated by a number of pulses, as is commonly used in CELP coding for generation of time domain FCB vectors. Typically, a successful FSCB has the capability of introducing, into a synthesized segment spectrum (and hence into the ASCB), spectral components which have not been present in previous synthesized signals that represented in the ASCB. Pre-training of the FSCB could be performed using a large set of audio signals representing possible spectral magnitude distributions.

An encoder 110 could, if desired, as part of the encoding of a signal segment, furthermore generate a synthesized TD signal segment, $\overline{Z}$. This would correspond to performing step 320 of the decoding method flowchart illustrated in FIG. 3, and the encoder 110 could include corresponding TD signal segment synthesizing apparatus. The synthesis of the TD signal segment in the encoder 110, as well as in the decoder 112, could be beneficial if encoding parameters are determined in dependence of the synthesized TD signal segment, cf. for example expression (19) below.

Figure 3:
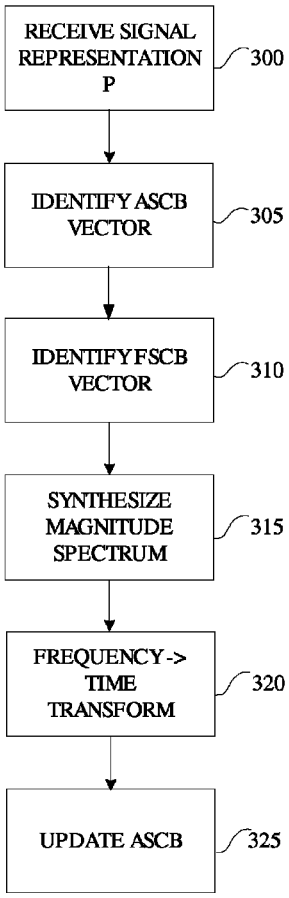
FIG. 3 is a flowchart illustrating a method of decoding a signal representation and synthesizing an audio signal.

An embodiment of a decoding method is shown in FIG. 3, which decoding method allows the decoding of a signal segment which has been encoded by means of the method illustrated in FIG. 2. At step 300, a representation P of a signal segment is received in a decoder 112. The representation P is indicative of an index $i_{ASCB}$ &an index $i_{FSCB}$, a gain $g_{ASCB}$ & a gain $g_{FSCB}$ (possibly represented by a global gain and a gain ratio).

At step 305, a first ASCB vector $\overline{C}_{A,i_{ASCB}}$, providing an approximation of the segment spectrum $\overline{S}$, is identified in an ASCB of the decoder 112 by means of the ASCB index $i_{ASCB}$. The ASCB of the decoder 112 has the same structure as the ASCB of the encoder 110, and has advantageously been initialized in the same manner. As will be seen in relation to step 325, the ASCB of the decoder 112 is also updated in the same manner as the ASCB of the encoder 110. At step 310, an FSCB vector $\overline{C}_{F,i_{FSCB}}$ providing an approximation of the residual spectrum $\overline{R}$ is identified in an FSCB of the decoder 112 by means of the FSCB index $i_{FSCB}$. The FSCB of the decoder 112 is advantageously identical to the FSCB of the encoder 110, or, at least, comprises corresponding vectors $\overline{C}_{F,i_{FSCB}}$ which can be identified by FSCB indices $i_{FSCB}$.

At step 315, a synthesized magnitude spectrum $\overline{Y}$ is generated as a linear combination of the identified ASCB vector $\overline{C}_{A,i_{ASCB}}$ and the identified FSCB vector $\overline{C}_{F,i_{FSCB}}$. Any negative frequency bin values are handled in the same manner as in step 225 of FIG. 2 (cf. discussion in relation to expression (8)).

At step 320, a frequency-to-time transform, i.e. the inverse of the time-to-frequency transform used in step 205 of FIG. 2, is applied to a synthesized spectrum $\overline{B}$ having the synthesized magnitude spectrum $\overline{Y}$ obtained in step 315, resulting in a synthesized TD signal segment $\overline{Z}$. As will be further discussed below, a phase spectrum of the segment spectrum can also be taken into account when performing the inverse transform, for example as a random phase spectrum, or as a parameterized phase spectrum. Alternatively, a predetermined phase spectrum will be assumed for the synthesized spectrum $\overline{B}$. From the synthesized TD signal segment $\overline{Z}$, a synthesized audio signal 125 can be obtained. If any pre-processing had been performed in the encoder 110 prior to entering step 205, the inverse of such pre-processing will be applied to the synthesized TD signal $\overline{Z}$ to obtain the synthesized audio signal 125.

When the discrete Fourier transform (DFT) has been used by the encoder 110 in step 205, the synthesized TD signal segment is obtained by applying, to the synthesized segment spectrum $\overline{B}$, the inverse DFT (IDFT):

$$Z(n) = \frac{1}{N}\sum_{k=0}^{N-1} B(k)e^{j2\pi nk/N}, \quad n = 0, 1, 2, \ldots, (N-1). \tag{12}$$

When the discrete Fourier transform (DFT) is used for the encoding, step 320 could advantageously further include, prior to performing the IDFT, an operation whereby the symmetry of the DFT is reconstructed in order to obtain a real-valued signal in the time domain:

$$B(M+k)=B^*(M-k), k=1,2,3,\ldots(M-2) \tag{13}$$

where (*) denotes the complex conjugate operator.

Figure 4:
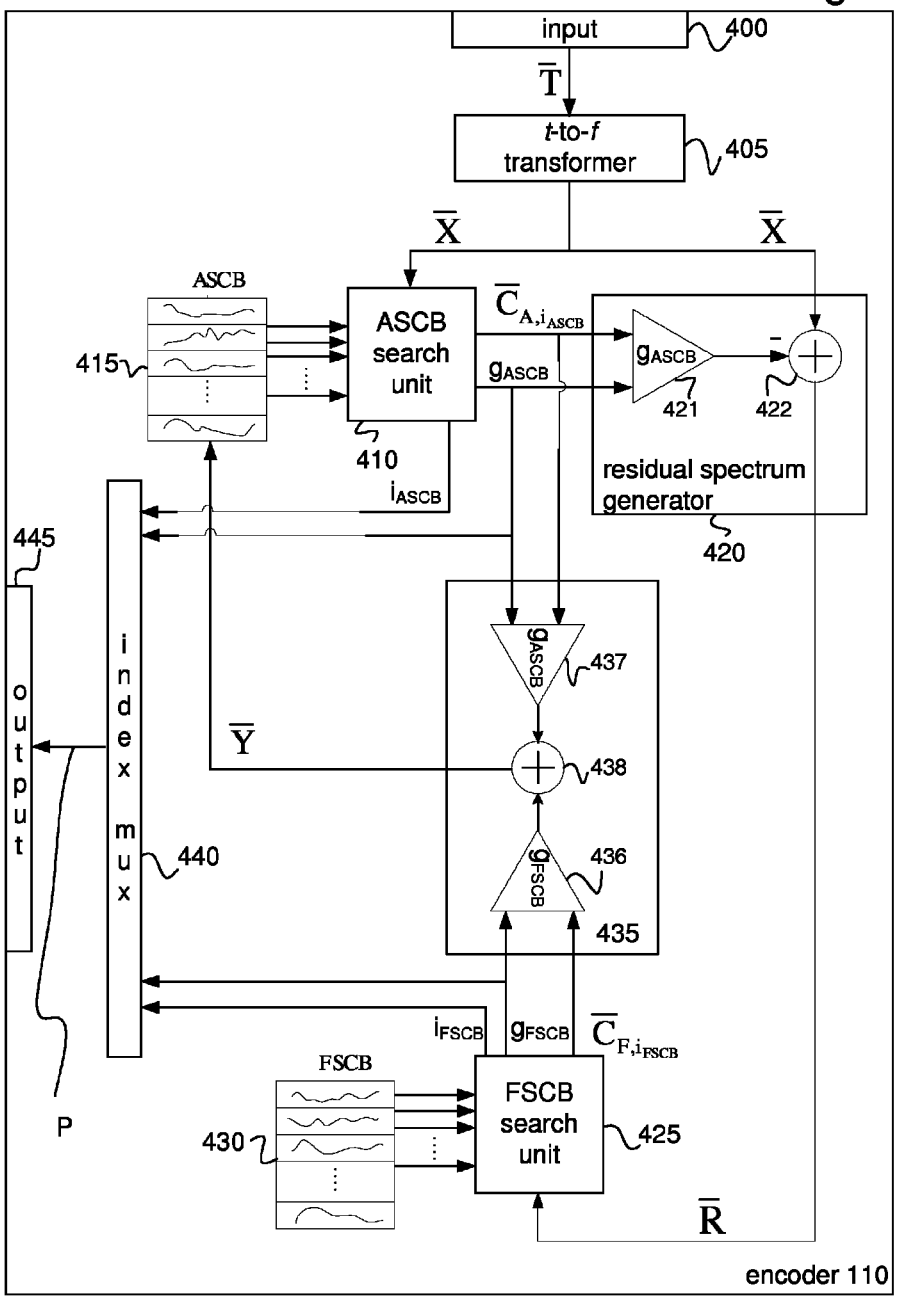
FIG. 4 schematically illustrates an embodiment of an audio encoder.

An encoder 110 which is configured to perform the method illustrated by FIG. 2 is schematically shown in FIG. 4. The encoder 110 of FIG. 4 comprises an input 400, a t-to-f transformer 405, an ASCB search unit 410, an ASCB 415, a residual spectrum generator 420, an FSCB search unit 425, an FSCB 430, a magnitude spectrum synthesizer 435, an index multiplexer 440 and an output 445. Input 400 is arranged to receive a TD signal segment $\overline{T}$, and to forward the TD signal segment $\overline{T}$ the t-to-f transformer 405 to which it is connected. The t-to-f transformer 405 is arranged to apply a time-to-frequency transform to a received TD signal segment $\overline{T}$, as discussed above in relation to step 205 of FIG. 2, so that a segment spectrum $\overline{S}$ is obtained. The t-to-f transformer 405 of FIG. 4 is further configured to derive the magnitude spectrum $\overline{X}$ of an obtained segment spectrum $\overline{S}$ by use of expression (2) above. The t-to-f transformer 405 of FIG. 4 is connected to the ASCB search unit 410, as well as to the residual spectrum generator 420, and arranged to deliver a derived magnitude spectrum $\overline{X}$ to the ASCB search unit 410 as well as to the residual spectrum generator 420.

The ASCB search unit 410 is further connected to the ASCB 415, and configured to search for and select an ASCB vector $\overline{C}_{A,i_{ASCB}}$ which can provide a first approximation of the magnitude spectrum $\overline{X}$, for example using expression (3). The ASCB search unit 410 is further configured to deliver, to the index multiplexer 440, a signal indicative of an ASCB index $i_{ASCB}$ identifying the selected ASCB vector $\overline{C}_{A,i_{ASCB}}$. The ASCB search unit 410 is further configured to determine a suitable ASCB gain, $g_{ASCB}$, for example by use of expression (4) above, and to deliver, to the index multiplexer 440 as well as to the residual spectrum generator, a signal indicative of the determined ASCB gain $g_{ASCB}$. The ASCB 415 is connected (for example responsively connected) to the ASCB search unit 410 and configured to deliver signals representing different ASCB vectors stored therein to the ASCB search unit 410 upon request from the ASCB search unit 410.

The residual spectrum generator 420 is connected (for example responsively connected) to the ASCB search unit 410 and arranged to receive the selected ASCB vector $\overline{C}_{A,i_{ASCB}}$ and the ASCB gain from the ASCB search unit 410. The residual spectrum generator 420 is configured to generate a residual spectrum $\overline{R}$ from a selected ASCB vector and gain received from the ASCB search unit 420, and corresponding magnitude spectrum $\overline{X}$ received from the t-to-f transformer 420 (cf. expression (5). In the residual spectrum generator 420 of FIG. 4, an amplifier 421 and an adder 422 are provided for this purpose. The amplifier 421 is configured to receive the selected ASCB vector $\overline{C}_{A,i_{ASCB}}$ and the gain $g_{ASCB}$, and to output a first approximation of the segment spectrum. The adder 422 is configured to receive the magnitude spectrum $\overline{X}$ as well as the first approximation of the segment spectrum; to subtract the first approximation from the magnitude spectrum $\overline{X}$; and to output the resulting vector as the residual vector $\overline{R}$.

The FSCB search unit 425 is connected (for example responsively connected) to the output of residual spectrum generator 420 and configured to search for and select, in response to receipt of a residual spectrum $\overline{R}$, an FSCB vector $\overline{C}_{F,i_{FSCB}}$ which can provide a residual spectrum approximation, for example using expression (6). For this purpose, the FSCB search unit 425 is connected to the FSCB 430, which is connected (for example responsively connected) to the FSCB search unit 425 and configured to deliver signals representing different FSCB vectors stored in FSCB 430 to the FSCB search unit 410 upon request from the FSCB search unit 410.

The FSCB search unit 425 is further connected to the index multiplexer 440 and the spectrum magnitude synthesizer 435, and configured to deliver, to the index multiplexer 440, a signal indicative of an FSCB index $i_{FSCB}$ identifying the selected FSCB vector $\overline{C}_{F,i_{FSCB}}$. The FSCB search unit 425 is further configured to determine a suitable FSCB gain, $g_{FSCB}$, for example by use of expression (7) above, and to deliver, to the index multiplexer 440 as well as to the spectrum magnitude synthesizer 435, a signal indicative of the determined FSCB gain $g_{FSCB}$.

The magnitude spectrum synthesizer 435 is connected (for example responsively connected) to the ASCB search unit 410 and the FSCB search unit 425, and configured to generate a synthesized magnitude spectrum $\overline{Y}$. For this purpose, the magnitude spectrum synthesizer 435 of FIG. 4 comprises two amplifiers 436 and 437, as well as an adder 438. Amplifier 436 is configured to receive the selected FSCB vector $\overline{C}_{F,i_{FSCB}}$ and the FSCB gain $g_{FSCB}$ from the FSCB search unit 425, while amplifier 437 is configured to receive the selected ASCB vector $\overline{C}_{A,i_{ASCB}}$ and the ASCB gain $g_{ASCB}$ from the ASCB search unit 410. Adder 438 is connected to the outputs of amplifier 436 and 437, respectively, and configured to add the output signals, corresponding to the residual spectrum approximation and the first approximation of the segment spectrum, respectively, to form the synthesized magnitude spectrum $\overline{Y}$, which is delivered at an output of the magnitude spectrum synthesizer 435. This output of the magnitude spectrum synthesizer 435 is connected to the ASCB 415, so that the ASCB 415 may be updated with a synthesized magnitude spectrum $\overline{Y}$. The magnitude spectrum synthesizer 435 could further be configured to zero any frequency bins having a negative magnitude (cf. expression (8)), and/or to normalize the synthesized magnitude spectrum $\overline{Y}$ prior to delivering the synthesized spectrum $\overline{Y}$ to the ASCB 415. Normalization of $\overline{Y}$ could alternatively be performed by the ASCB 415, in a separate normalization unit connected between 435 and 415, or be omitted. In an implementation wherein a synthesized TD signal segment is generated in the encoder 110, the encoder 110 could furthermore advantageously include an f-to-t transformer connected to an output of the magnitude spectrum synthesizer 435 and configured to receive the (unnormalized) synthesized magnitude spectrum $\overline{Y}$.

As mentioned in the above, the index multiplexer 440 is connected to the ASCB search unit 410 and the FSCB search unit 425 so as to receive signals indicative of an ASCB index $i_{ASCB}$ & an FSCB index $i_{FSCB}$, as well as an ASCB gain & an FSCB index. The index multiplexer 440 is connected to the encoder output 445 and configured to generate a signal representation P, carrying a values indicative of an ASCB index $i_{ASCB}$ & an FSCB index $i_{FSCB}$, as well as of a quantized values of the ASCB gain and the FSCB gain (or of a gain ratio and a global gain as discussed in relation to step 220 of FIG. 2).

Figure 5:
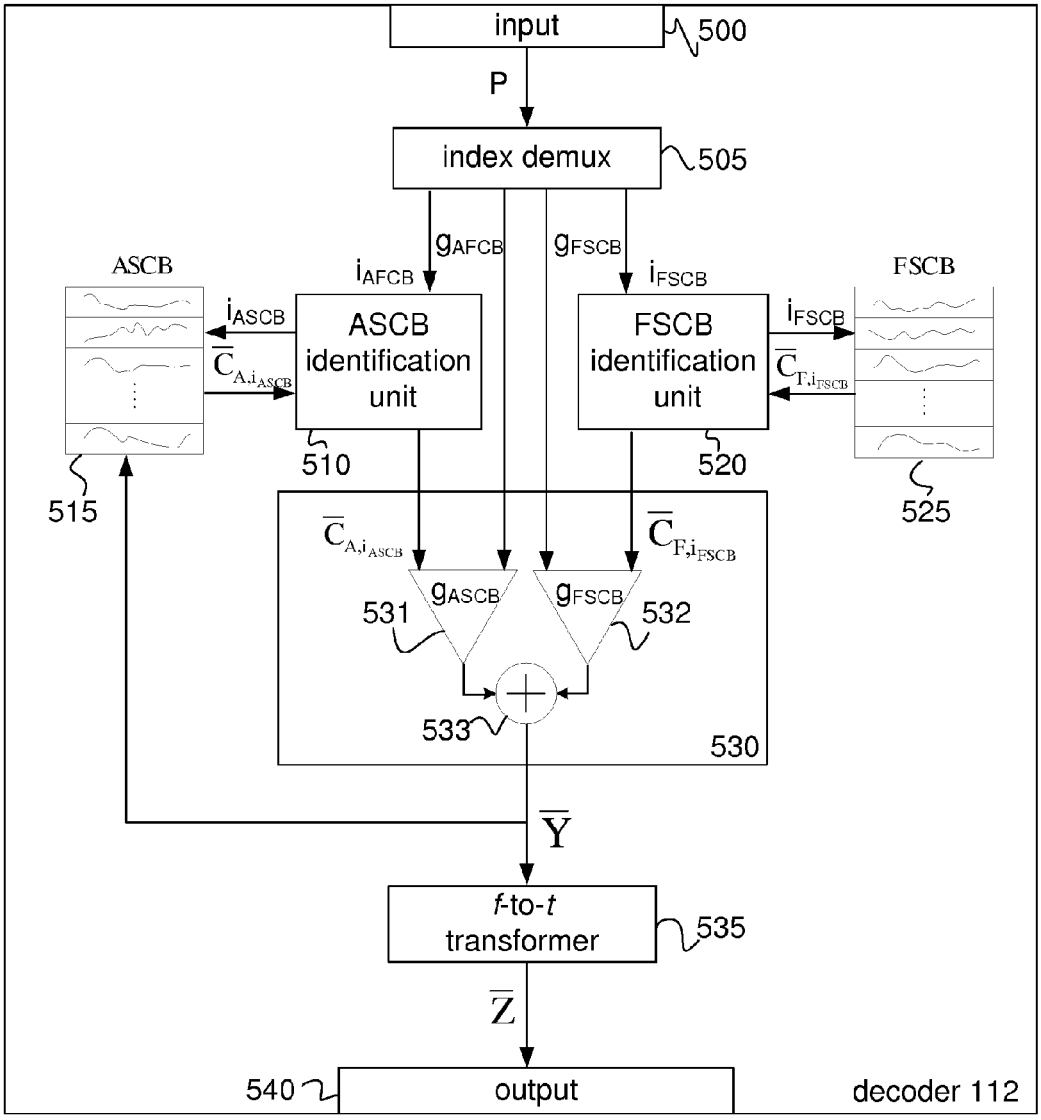
FIG. 5 schematically illustrates an embodiment of an audio decoder.

FIG. 5 is a schematic illustration of an example of a decoder 112 which is configured to decode a signal segment having been encoded by the encoder 110 of FIG. 4. The decoder 112 of FIG. 5 comprises an input 500, an index demultiplexer 505, an ASCB identification unit 510, an ASCB 515, an FSCB identification unit 520, an FSCB 525, a magnitude spectrum synthesizer 530, an f-to-t transformer 535 and an output 540. The input 500 is configured to receive a signal representation P and to forward the signal representation P to the index demultiplexer 505. The index demultiplexer 505 is configured to retrieve, from the signal representation P, values corresponding to an ASCB index $i_{ASCB}$ & an FSCB index $i_{FSCB}$, and an ASCB gain $g_{ASCB}$ & an FSCB gain $g_{FSCB}$ (or a global gain and a gain ratio). The index demultiplexer 505 is further connected to the ASCB identification unit 510, the FSDC identification unit 520 and to the magnitude spectrum synthesizer 530, and configured to deliver $i_{ASCB}$ to the ASCB search unit 510, to deliver $i_{FSCB}$ to the FSCB search unit 520, and to deliver $g_{ASCB}$ as well as $g_{FSCB}$ to the magnitude spectrum synthesizer 530.

The ASCB identification unit 510 is connected (for example responsively connected) to the index demultiplexer 505 and arranged to identify, by means of a received value of the ASCB index $i_{ASCB}$, an ASCB vector $\overline{C}_{A,i_{ASCB}}$ which was selected by the encoder 110 as the selected ASCB vector. The ASCB identification unit 510 is furthermore connected to the magnitude spectrum synthesizer 530, and configured to deliver a signal indicative of the identified ASCB vector to the magnitude spectrum synthesizer 530. Similarly, the FSCB identification unit 520 is responsibly connected to the index demultiplexer 505 and arranged to identify, by means of a received value of the FSCB index $i_{ASCB}$, an FSCB vector $\overline{C}_{F,i_{FSCB}}$ which was selected by the encoder 110 as the selected FSCB vector. The FSCB identification unit 510 is furthermore connected to the magnitude spectrum synthesizer 530, and configured to deliver a signal indicative of the identified FSCB vector to the magnitude spectrum synthesizer 530.

The magnitude spectrum synthesizer 530 can, in one implementation, be identical to the magnitude spectrum synthesizer 435 of FIG. 4, and is shown to comprise an amplifier 531 configured to receive the identified ASCB vector $\overline{C}_{A,i_{ASCB}}$ & the ASCB gain $g_{ASCB}$, and an amplifier 532 configured to receive the identified FSCB vector $\overline{C}_{F,i_{FSCB}}$ & the FSCB gain $g_{FSCB}$. The adder 533 is configured to receive the output from the amplifier 531, corresponding to the first approximation of the segment spectrum, as well as to receive the output from the amplifier 532, corresponding to the residual spectrum approximation, and configured to add the two outputs in order to generate a synthesized magnitude spectrum $\overline{Y}$. The output of the magnitude spectrum synthesizer 530 is connected to the ASCB 515, so that the ASCB 515 may be updated with a synthesized magnitude spectrum $\overline{Y}$. As the magnitude spectrum synthesizer 435, the magnitude spectrum synthesizer 530 could further be configured to zero any frequency bins having a negative magnitude (cf. expression (8)), and/or to normalize the synthesized magnitude spectrum $\overline{Y}$ prior to delivering the synthesized spectrum $\overline{Y}$ to the ASCB 515. Normalization of $\overline{Y}$ could alternatively be performed by the ASCB 515, in a separate normalization unit connected between 530 and 515, or be omitted, depending on whether or not normalization is performed in the encoder 110. In any event, the magnitude spectrum synthesizer 435 is configured to deliver a signal indicative of the un-normalized synthesized magnitude spectrum $\overline{Y}$ to the f-to-t transformer 535.

The f-to-t transformer 535 is connected (for example responsively connected) to the output of magnitude spectrum synthesizer 530, and configured to receive a signal indicative of the synthesized magnitude spectrum $\overline{Y}$. The f-to-t transformer 535 is furthermore configured to apply, to a received synthesized magnitude spectrum $\overline{Y}$, the inverse of the time-to-frequency transform used in the encoder 110 (i.e. a frequency-to-time transform), in order to obtain a synthesized TD signal $\overline{Z}$. The f-to-t transformer 535 is connected to the decoder output 540, and configured to deliver a synthesized TD signal to the output 540.

In FIGS. 4 and 5, ASCB search unit 410 & ASCB identification unit 510 are shown to be arranged to deliver a signal indicative of the selected/identified ASCB vector $\overline{C}_{A,i_{ASCB}}$, while FSCB search unit 425 and FSCB identification unit 520 are similarly shown to be arranged to deliver a signal indicative of the selected/identified FSCB vector $C_{F,i_{FSCB}}$. In another implementation, the selected ASCB vector $\overline{C}_{A,i_{ASCB}}$ could be delivered directly from the ASCB 415/515, upon request from the ASCB search unit 410/ASCB identification unit 510, and the selected FSCB vector $\overline{C}_{F,i_{FSCB}}$ could similarly be delivered directly from the FSCB 425/525.

In FIGS. 2-5, the ASCB 415/515 is shown to be updated with the synthesized magnitude spectrum $\overline{Y}$. In one embodiment, this updating of the ASCB 415/515 is conditional on the properties of the synthesized magnitude spectrum $\overline{Y}$. A reason for providing a dynamic ASCB 415/515 is to adapt the possibilities of finding a suitable first approximation of a segment spectrum to a pattern in the audio signal 115 to be encoded. However, there may be some signal segments for which the segment spectrum $\overline{S}$ will not be particularly relevant to the encodability of any following signal segment. In order to allow for the ASCB 415/515 to include a larger number of useful ASCB vectors, a mechanism could be implemented which reduces the number of such irrelevant segment spectra introduced into the ASCB 415/515. Examples of signal segments, for which the segment spectra could be considered irrelevant to the future encodability, are signal segments which are dominated by sounds that are not part of the content carrying audio signal that it is desired to encode, signal segments which are dominated by sounds that are not likely to be repeated; or signal segments which mainly carry silence or near-silence, etc. In the near-silence region, the synthesis would typically be sensitive to noise from numerical precision errors, and such spectra will be less useful for future predictions.

Figure 6:
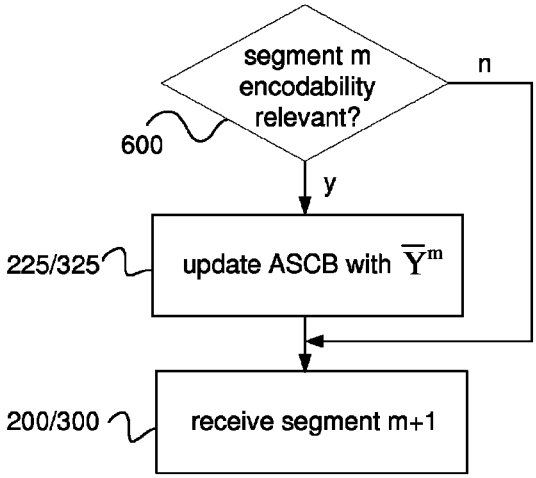
FIG. 6 is a flowchart illustrating a feature of an embodiment of the encoding and decoding methods.

Hence, a check as to the relevance of a signal segment may be performed prior to updating the ASCB 415/15 with the corresponding synthesized magnitude spectrum $\overline{Y}$. An example of such check is illustrated in the flowchart of FIG. 6. The check of FIG. 6 is applicable to both the encoder 110 and the decoder 112, and if it has been implemented in one of them, it should be implemented in the other, in order to ensure that the ASCBs 415 and 515 include the same ASCB vectors. At step 600, it is checked whether a signal segment m is relevant for the encodability of future signal segments. If so, step 225 (encoder) or step 325 (decoder) is entered, wherein the ASCB 415/515 is updated with the synthesized magnitude spectrum $\overline{Y}^m$. Step 200 (encoder) or step 300 (decoder) is then re-entered, wherein a signal representing the next signal segment m+1 is received. However, if it is found in step 600 that the signal segment m is irrelevant for the future encodability, then step 225/325 is omitted for segment m, and step 200/300 is re-entered without having performed step 225/325. Step 600 could, if desired, be performed at an early stage in the encoding/decoding process, in which case several steps would typically be performed between step 600 and steps 225/325 or steps 200/300. Although step 225/325 is shown in FIG. 6 to be performed prior to the re-entering of the step 200/300, there is no particular order in which these two steps should be performed.

In one implementation, the global energy $g_{global}$ of the signal segment could be used as a relevance indicator. The check of step 600 could in this implementation be a check as to whether the global gain exceeds a global gain threshold: $g_{global}^{m} > g_{global}^{threshold}$. If so, the ASCB 415/515 will be updated with $\overline{Y}^m$, otherwise not. In this implementation, the ASCB 415/515 will not be updated with spectra of signal segments which carry silence or near-silence, depending on how the threshold is set.

In another implementation, the encodability relevance check could involve a relevance classification of the content of signal segment. The relevance indicator could in this implementation be a parameter that takes one of two values: "relevant" or "not relevant". For example, if the content of a signal segment is classified as "not relevant", the updating of the ASCB 415/515 could be omitted for such signal segment. Relevance classification could for example be based on voice activity detection (VAD), whereby a signal segment is labeled as "voice active" or "voice inactive". A voice inactive signal segment could be classified as "not relevant", since its contents could be assumed to be less relevant to future encodability. VAD is known in the art and will not be discussed in detail. Relevance classification could for example be based on signal activity detection (SAD) as described in ITU-T G.718 section 6.2. A signal segment which is classified as active by means of SAD would be considered "relevant" for relevance classification purposes.

Figure 7:
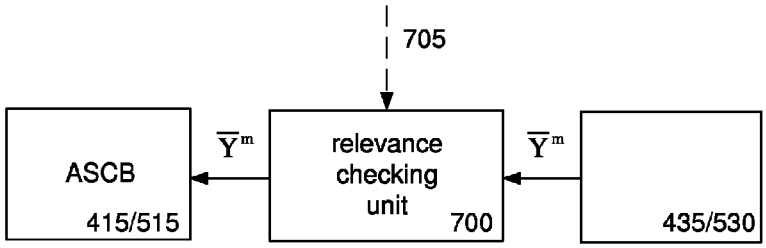
FIG. 7 schematically illustrates a feature of an embodiment of the codec.

In an embodiment wherein the updating of the ASCB 415/515 is conditional on the relevance of a signal segment, the encoder 110 and decoder 112 will comprise a relevance checking unit, which could for example be connected to the output of the magnitude spectrum synthesizer 435/530. An example of such relevance checking unit 700 is shown in FIG. 7. The relevance checking unit 700 is arranged to perform step 600 of FIG. 6. In one implementation, an analysis providing a value of a relevance indicator could be performed by the relevance checking unit 700 itself, or the relevance checking unit 700 could be provided with a value of a relevance indicator from another unit of the encoder 110/decoder 112, as indicated by the dashed line 705. In FIG. 7, the relevance checking unit is shown to be connected to the magnitude spectrum synthesizer 435/530 and configured to receive a synthesized spectrum $\overline{Y}^m$. The relevance checking unit 700 is further arranged to perform the decision of step 600 of FIG. 6. For this decision, a value of a relevance indicator is typically required, as well as a value of a relevance threshold or a relevance fulfillment value. A relevance fulfillment value could for example be used instead of a relevance threshold if the relevance check involves a characterization of the content of the signal segment, the result of which can only take discrete values. The value of the relevance threshold/fulfillment value could advantageously be stored in the relevance checking unit 700, for example in a data memory. Regarding the value of the relevance indicator, the relevance checking unit could, in one implementation, be configured to derive this value from $\overline{Y}^m$, for example if the relevance indicator is the global energy $g_{energy}$. Alternatively, the relevance checking unit 700 could be configured to receive this value from another entity in the encoder 110/decoder 112, or be configured to receive a signal from which such value can be derived (e.g. a signal indicative of the TD signal segment $\overline{T}$). The dashed arrow 705 in FIG. 7 indicates that the relevance checking unit 700 may, in some embodiment, be connected to further entities from which signals can be received by means of which a value of the relevance parameter may be derived. The relevance checking unit 700 is further connected to the ASCB 415/515 and configured to, if the check of a signal segment indicates that the signal segment is relevant for the encodability of future signal segments, forward the synthesized magnitude spectrum $\overline{Y}$ to the ASCB 415/515.

In some encoding situations, for example if the character of the audio signal 115 changes drastically so that the spectrum of a signal segment has few similarities with the spectra of previous signal segments, or when the ASCB 415/515 have just been initiated, there might not be an ASCB vector in the ASCB 415 which can provide a good approximation of the magnitude spectrum $\overline{X}$. In one embodiment, a fast convergence search mode of the codec is provided for such encoding situations. In the fast convergence search mode, a segment spectrum is synthesized by means of a linear combination of at least two FSCB vectors, instead of by means of a linear combination of one ASCB vector and one FSCB vector. In this mode, the bits allocated in the signal representation P for transmission of an ASCB index are instead used for the transmission of an additional FSCB index. Hence, the ASCB/FSCB bit allocation in the signal representation P is changed.

A criterion for entering into the fast convergence search mode could be that a quality estimate of the first approximation of the segment spectrum indicates that the quality of the first approximation would lie be below a quality threshold. An estimation of the quality of a first approximation could for example include identifying a first approximation of the segment spectrum by means of an ASCB search as described above, and then derive a quality measure (e.g. the ASCB gain, $g_{ASCB}$) and compare the derived quality measure to a quality measure threshold (e.g. a threshold ASCB gain, $g_{ASCB}^{threshold}$) A threshold ASCB gain could for example lie at 60 dB below nominal input level, or at a different level. The threshold ASCB gain is typically selected in dependence on the nominal input level. If the ASCB gain lies below the ASCB gain threshold, then the quality of the first approximation could be considered insufficient, and the fast convergence search mode could be entered. Alternatively, the quality estimation could be performed by means of an onset classification of the signal segment, prior to searching the ASCB 415, where the onset classification is performed in a manner so as to detect rapid changes in the character of the audio signal 115. If a change of the audio signal character between two segments lies above a change threshold, then the segment having the new character is classified as an onset segment. Hence, if an onset classification indicates that the segment is an onset segment, it can be assumed that the quality of the first approximation would be insufficient, had an ASCB search been performed, and no ASCB search would have to be carried out for the onset signal segment. Such onset classification could for example be based on detection of rapid changes of signal energy, on rapid changes of the spectral character of the audio signal 115, or on rapid changes of any LP filter, if an LP filtering of the audio signal 115 is performed. Onset classification is known in the art, and will not be discussed in detail.

Figure 8:
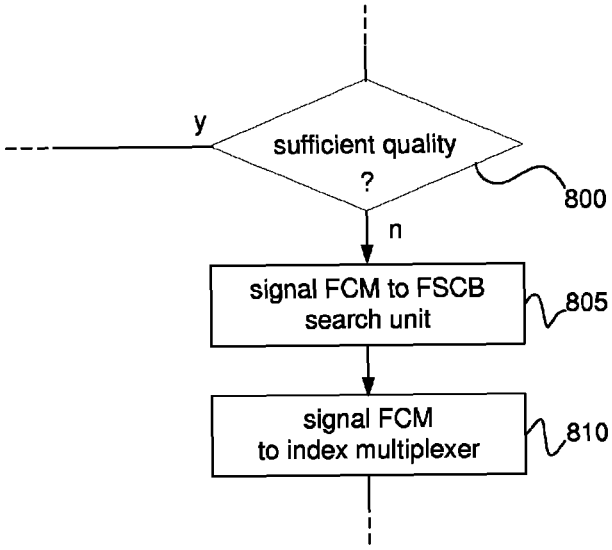
FIG. 8 is a flowchart illustrating a feature of an embodiment of the encoding method.

FIG. 8 is a flowchart schematically illustrating a method whereby the fast convergence search mode (FCM) can be entered. In step 800, it is determined whether estimation as to the quality of the first approximation of the segment spectrum shows that the quality would be sufficient. If so, the encoder 110 will stay in normal operation, wherein an ASCB vector and an FSCB vector are used in the synthesis of the segment spectrum. However, if it is determined in step 800 that the quality of the first approximation will be insufficient, fast convergence search mode will be assumed, wherein a segment spectrum is synthesized by means of a linear combination of at least two FSCB vectors, instead of by means of a linear combination of one ASCB vector and one FSCB vector. In step 805, a signal is sent to the FSCB search unit 425 to inform the FSCB search unit 425 that the fast convergence search mode should be applied to the current signal segment. Step 810 is also entered (and could, if desired, be performed before, or at the same time as, step 805), wherein a signal is sent to the index multiplexer 440, informing the index multiplexer 440 that the fast convergence search mode should be signaled to the decoder 112. The signal representation P could for example include a flag to be used for this purpose.

In an embodiment wherein the quality estimation is based on the evaluation of the ASCB gain, the ASCB search unit 415 of the encoder 110 could be equipped with a first approximation evaluation unit, which could for example be configured to operate according to the flowchart of FIG. 8, where step 800 could involve a comparison of the ASCB gain to the threshold ASCB gain. In an embodiment wherein the quality estimation is based on a detection of rapid changes in the audio signal 115, an onset classifier could be provided, either in the encoder 110, or in equipment external to the encoder 110.

In the fast convergence search mode, the FSCB code book is in step 215 searched for at least two FSCB vectors instead of one. In one implementation, wherein the FSCB code book is searched for two FSCB vectors in the FCM, an index pair $(i_{FCB,1}, i_{FCB,2})$ is desired which minimizes the error given by the following expression:

$$(i_{FSCB,1}, i_{FSCB,2}) = \underset{(i_1,i_2)}{\operatorname{argmin}} \sum_{k=0}^{M-1} (R(k) - g_{FSCB,1} C_{F,i_1,k} - g_{FSCB,2} C_{F,i_2,k})^2. \tag{14}$$

The two FSCB gains can, just like the gains in the normal mode, be described by means of a global energy $g_{energy}$ and a gain ratio, $$g_\alpha = \frac{g_{FCB,1}}{g_{FCB,2}}.$$

In an embodiment wherein the fast convergence search mode is provided as an alternative to normal encoding, the FSCB search unit 425 of the decoder could advantageously be connected to the magnitude spectrum synthesizer 435 in a manner so that the FSCB search unit can, when in fast convergence search mode, provide input signals to the amplifier 437, as well as to the amplifier 436. The spectral synthesis in the fast convergence search mode can be described by:

$$Y(k) = g_{FSCB,1} C_{F,i_{FSCB,1},k} + g_{FSCB,2} C_{F,i_{FSCB,2},k} \tag{15a},$$

or $$Y(k) = g_{global}(C_{F,i_{FSCB,1},k} + g_\alpha C_{F,i_{FSCB,2},k}). \tag{15b}$$

In the decoder, the index de-multiplexer 505 should advantageously be configured to determine whether an FCM indication is present in the signal representation P, and if so, to send the two vector indices of the signal representation P to the FSCB identification unit 520 (possibly together with an indication that the fast convergence search mode should be applied). The FSCB identification unit 520 is, in this embodiment, configured to identify two FSCB vectors in the FSCB 525 upon the receipt of two FSCB indices in respect of the same signal segment. The FSCB identification unit 520 is further advantageously connected to the magnitude spectrum synthesizer 530 in a manner so that the FSCB identification unit 530 can, when in fast convergence search mode, provide input signals to the amplifier 431, as well as to the amplifier 532.

The fast convergence search mode could be applied on a segment-by-segment basis, or the encoder 110 and decoder 112 could be configured to apply the FCM to a set of n consecutive signal segments once the FCM has been initiated. The updating of the ASCB 415/515 with the synthesized magnitude spectrum can in the fast convergence search mode advantageously be performed in the same manner as in the normal mode.

As discussed above, a synthesized segment spectrum $\overline{B}$ is obtained from a synthesized magnitude spectrum $\overline{Y}$, and the above description concerns the encoding of the magnitude spectrum $\overline{X}$ of a segment spectrum. However, audio signals are also sensitive to the phase of the spectrum. Hence, the phase spectrum of a signal segment could also be determined and encoded in the encoding method of FIG. 2. The representation of the segment spectrum $\overline{S}$ would then be divided into the magnitude spectrum $\overline{X}$ and a phase spectrum $\overline{\phi}$:

$$X(k)=|S(k)|, k=0,1,2,3 \ldots (M-1) \tag{16a}$$

$$\Phi(k)=\angle S(k), k=0,1,2,3 \ldots (M-1) \tag{16b}$$

The t-to-f transformer 405 could be configured to determine the phase spectrum. A phase encoder could, in one embodiment, be included in the encoder 110, where the phase encoder is configured to encode the phase spectrum and to deliver a signal indicative of the encoded phase spectrum to the index multiplexer 440, to be included in the signal representation P to be transmitted to the decoder 112. The parameterization of the phase spectrum $\overline{\phi}$ could for example be performed in accordance with the method described in section 3.2 of "*High Quality Coding of Wideband Audio Signals using Transform Coded Excitation* (*TCX*)", R. Lefebvre et al., *ICASSP* 1994, pp. I/193-I/196 vol. 1, or by any other suitable method. A synthesized segment spectrum $\overline{B}$ will take the form:

$$B(k)=Y(k)\cdot e^{j2\pi\cdot\phi(k)}, k=1,2,3 \ldots ,(M-2) \tag{17}$$

The DC component of B (k=0) and the Nyquist frequency component (k=M−1) are real values.

However, for signal segments carrying noise-like audio information, such as fricatives, the phase spectrum is generally not as important as for signal segments carrying harmonic content, such as voiced sounds or music.

For a phase insensitive signal segment, which could for example be a signal segment carrying noise or noise-like sounds (e.g. unvoiced sounds), the full phase spectrum $\overline{\phi}$ does not have to be determined and parameterized. Hence, less information will have to be transmitted to the decoder 112, and bandwidth can be saved. However, to base the synthesized segment spectrum on the synthesized magnitude spectrum only, and thereby use the same phase spectrum for all segment spectra, will typically introduce undesired artefacts. By assigning a random, or pseudo-random, phase spectrum to the synthesized segment spectrum $\overline{B}$, such undesired artefacts can much be avoided. The random phase spectrum is here denoted $\overline{V}$. The final complex synthesized phase spectrum would then be:

$$B(k)=\begin{cases} Y(k), & k=0 \\ Y(k)\cdot e^{j2\pi\cdot V}, & k=1,2,3 \ldots ,(M-2) \\ Y(k), & k=M-1, \end{cases} \tag{18}$$

where V(k) represents a pseudo-random variable which can advantageously have a uniform distribution in the range [0,1]. Therefore, the phase information provided to the f-to-t transformer 535 of the decoder 112 (or to a corresponding f-to-t-transformer of the encoder 110) in relation to phase insensitive segments could be based on information generated by a random generator in the decoder 112. The decoder 112 could, for this purpose, for example include a deterministic pseudo-random generator providing values having a uniform distribution in the range [0,1]. Such deterministic pseudo-random generators are well known in the art and will not be further described. Similarly, in applications wherein the encoder 110 is also configured to generate the full synthesized complex segment spectrum $\overline{B}$, in addition to the synthesized magnitude spectrum $\overline{Y}$, the encoder 110 could include such pseudo-random generator. In order for the encoder 110 and the decoder 112 to be synchronized, the same seed could advantageously be provided, in relation to the same signal segment, to the pseudo-random generators of the encoder 110 and the decoder 112. The seed could e.g. be pre-determined and stored in the encoder 110 and decoder 112, or the seed could be obtained from the contents of a specified part of the signal representation P upon the start of a communications session. If desired, the synchronization of random phase generation between the encoder 110 and decoder 112 could be repeated at regular intervals, e.g. $10^{th}$ or $100^{th}$ frame, in order to ensure that the encoder and decoder syntheses remain in synchronization.

In one implementation of an encoding mode wherein a random phase spectrum $\overline{V}$ is used in the generation of a synthesized segment spectrum $\overline{B}$ for phase insensitive segments, the sign of the real valued component of the segment spectrum $\overline{S}$ is determined and signaled to the decoder 112, in order for the decoder 112 to be able to use the sign of the DC component in the generation of $\overline{B}$. Adjusting the sign of the DC component of the synthesized segment spectrum $\overline{B}$ improves the stability of the energy evolution between adjacent segments. This is particularly beneficial in implementations where the segment length is short (for example in the order of 5 ms). When the segment length is short, the DC component will be affected by the local waveform fluctuations. By encoding the sign of the DC component as part of the signal representation P, sharp transitions at the segment boundaries, which otherwise may be present when a random phase spectrum is used, can generally be avoided. To provide information to the decoder 112 on the sign of the DC component of the phase spectrum, but to let the remaining parts of the phase spectrum used in the generation of the synthesized TD signal segment Z be randomly generated, can be seen as if one region (namely the DC component) of the phase spectrum is treated as phase sensitive, whereas another region (namely all other frequency components) are treated as phase insensitive.

At the decoder side, information on the phase spectrum $\overline{\phi}$ will be taken into account in step 320, wherein the f-to-t transform is applied to the synthesized spectrum. The f-to-t transformer 535 of FIG. 5 could advantageously be connected to the index de-multiplexer 505 (as well as to the output of the magnitude spectrum synthesizer 530) and configured to receive a signal indicative of information on the phase spectrum $\overline{\phi}$ of the segment spectrum, where such information is present in the signal representation P. Alternatively, the generation of a synthesized spectrum from a synthesized magnitude spectrum and received phase information could be performed in a separate spectrum synthesis unit, the output which is connected to the f-to-t transformer 530. As discussed above, phase information included in P could for example be a full parameterization of a phase spectrum, or a sign of the DC component of the phase spectrum. Furthermore, when a random phase spectrum is used at least for some signal segments, the f-to-t transformer 535 (or a separate spectrum synthesis unit) could be connected to a random phase generator.

Figure 9:
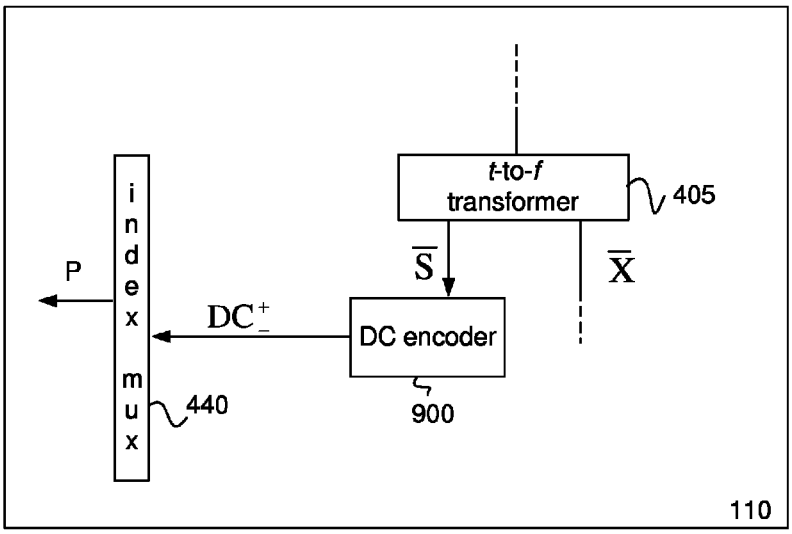
FIG. 9 schematically illustrates a feature of an embodiment of the encoder.

FIG. 9 schematically illustrates an example of an encoder 110 configured to provide an encoded signal P to a decoder 112 wherein a random phase spectrum $\overline{V}$, as well as information on the sign of the DC component, is used in generation of the synthesized TD signal segment $\overline{Z}$. Only mechanisms relevant to the phase aspect of the encoding have been included in FIG. 9, and the decoder 110 typically further includes other mechanisms shown in FIG. 5. In the embodiment of FIG. 9, the encoder 110 comprises a DC encoder 900, which is connected (for example responsively connected) to the t-to-f transformer 405 and configured to receive a segment spectrum $\overline{S}$ from the transformer 405. The DC encoder 900 is further configured to determine the sign of the DC component of the segment spectrum, and to send a signal DC± indicative of this sign to the index multiplexer 440, which is configured to include an indication of the DC sign in the signal representation P, for example as a flag indicator.

In an embodiment wherein a full parameterized phase spectrum is included in the signal representation P, the DC encoder 900 could be replaced or supplemented with a phase encoder configured to parameterize the full phase spectrum. In another embodiment, values representing the phase of some, but not all, frequency bins are parameterized, for example the p first frequency bins, $p<N$.

Figure 10:
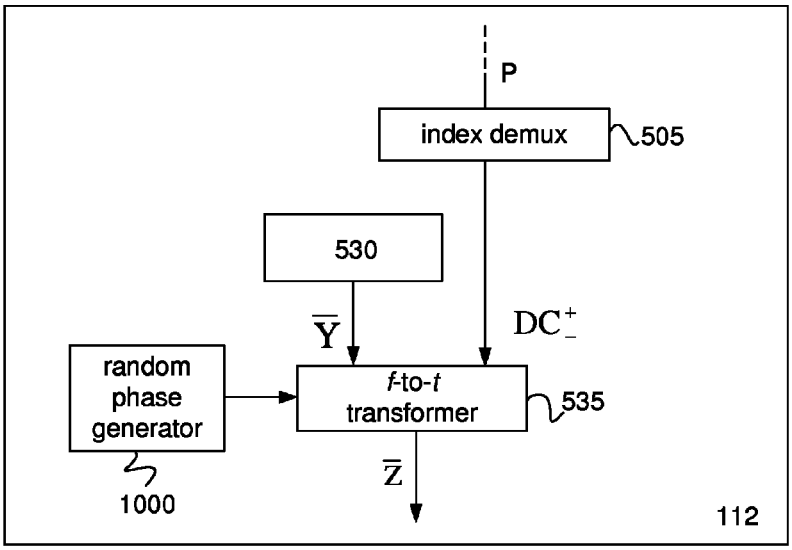
FIG. 10 schematically illustrates a decoder feature corresponding to the encoder feature shown in FIG. 9.

FIG. 10 schematically illustrates an example of a decoder 112 capable of decoding a signal representation P generated by the encoder 110 of FIG. 9. The decoder 112 of FIG. 10 comprises, in addition to the mechanisms shown in FIG. 5, a random phase generator 1000 connected to the f-to-t transformer 535 and configured to generate, and deliver to transformer 535, a pseudo-random phase spectrum $\overline{V}$ as discussed in relation to expression (18). In the embodiment of FIG. 10, the f-to-t transformer 535 is further configured to receive, from the index de-multiplexer 505, a signal indicative of the sign of the DC component of a segment spectrum, in addition to being configured to receive a synthesized magnitude spectrum $\overline{Y}$. The transformer 535 is configured to generate a synthesized TD signal segment $\overline{Z}$ in accordance with the received information (cf. expression (18)).

In an implementation of the encoder 110 wherein the synthesized TD signal segment $\overline{Z}$ is generated in the encoder 110, the encoder 110 would include a random phase generator 1000 and a f-to-t transformer 535 as shown in FIG. 10.

In an embodiment wherein a full parameterized phase spectrum is included in the signal representation P, the f-to-t transformer 535 of FIG. 10 could be configured to receive a signal of this parameterized phase spectrum from the index de-multiplexer 505. In an implementation wherein such information is provided for all signal segments, the random phase generator could be omitted.

In one embodiment, a signal segment is classified as either "phase sensitive" or "phase insensitive", and the encoding mode used in the encoding of the signal segment will depend on the result of the phase sensitivity classification. In this embodiment, the encoder 110 has a phase sensitive encoding mode and a phase insensitive encoding mode, while the decoder 112 has a phase sensitive decoding mode as well as a phase insensitive decoding mode. Such phase sensitivity classification could be performed in the time domain, prior to the f-to-t transform being applied to the TD signal segment $\overline{T}$ (e.g. at a pre-processing stage prior to the signal having reached the encoder 110, or in the encoder 110). Phase sensitivity classification could for example be based on a Zero Crossing Rate (ZCR) analysis, where a high rate of zero crossings of the signal magnitude indicates phase insensitivity—if the ZCR of a signal segment lies above a ZCR threshold, the signal segment would be classified as phase insensitive. ZCR analysis as such is known in the art and will not be discussed in detail. Phase sensitivity classification could alternatively, or in addition to an ZCR analysis, be based on spectral tilt—a positive spectral tilt typically indicates a fricative sound, and hence phase insensitivity. Spectral tilt analysis as such is also known in the art. Phase sensitivity classification could for example be performed along the lines of the signal type classifier described in ITU-T G.718, section 7.7.2.

Figure 11:
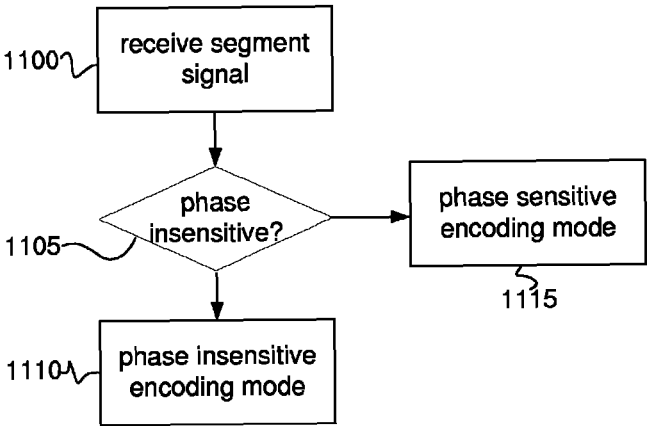
FIG. 11 is a flowchart illustrating a feature of an embodiment of the encoding method, whereby the encoder can enter one of a phase sensitive of phase insensitive encoding modes.

A schematic flowchart illustrating an example of such classification is shown in FIG. 11. The classification could be performed in a segment classifier, which could form part of the encoder 110, or be included in a part of the user equipment 105 which is external to the encoder 110. In step 1100, a signal indicative of a signal segment is received by a segment classifier, such as the TD signal segment $\overline{T}$, a signal representing the signal segment prior to any pre-processing, or a signal representing the segment spectrum, $\overline{S}$ or $\overline{X}$. At step 905, it is determined whether the signal segment is phase insensitive. If so, the phase insensitive mode is entered in step 1110. If not, the phase sensitive mode is entered step 1115. In this embodiment, the phase insensitive mode is a transform-based adaptive encoding mode wherein a random phase spectrum $\overline{V}$ is used in the generation of the synthesized spectrum, possibly in combination with information on the sign of the DC component of the segment spectrum $\overline{S}$, or information on the phase value of a few of the frequency bins, as described above. The phase sensitive encoding mode can for example be a time domain based encoding method, wherein the TD signal segment $\overline{T}$ does not undergo any time-to-frequency transform, and where the encoding does not involve the encoding of the segment spectrum. For example, the phase sensitive encoding mode could involve encoding by means of a CELP encoding method. Alternatively, the phase sensitive encoding mode can be a transform based adaptive encoding mode wherein a parameterization of the phase spectrum is signaled to the decoder 112 instead of using a random phase spectrum $\overline{V}$.

Information indicative of which encoding mode has been applied to a particular segment could advantageously be included in the signal representation P, for example by means of a flag, so that the decoder 110 will be aware of which decoding mode to apply.

The encoding of phase information relating to a phase insensitive signal segment can, as seen above, be made by use of fewer bits than the encoding of a the phase information of a phase sensitive signal. In an implementation wherein the phase sensitive mode is also a transform based encoding mode, the encoding of a phase insensitive signal segment could be performed such that the bits saved from the phase quantization are used for improving the overall quality, e.g. by using enhanced temporal shaping in noise-like segments.

The encoding mode wherein a random phase spectrum $\overline{V}$ is used in the generation of a synthesized segment spectrum $\overline{B}$ is typically beneficial for both background noises and noise-like active speech segments such as fricatives. One characteristic difference between these sound classes is the spectral tilt, which often has a pronounced upward slope for active speech segments, while the spectral tilt of background noise typically exhibits little or no slope. The spectral modeling can be simplified by compensating for the spectral tilt in a known manner in case of active speech segments. For this purpose, a voice activity detector (VAD) could be included in the encoding user equipment 105*a*, arranged to analyze signal segments in a known manner to detect active speech. The encoder 110 could include a spectral tilt mechanism, configured to apply a suitable tilt to a TD signal segment $\overline{T}$ in case active speech has been detected. A VAD flag could be included in the signal representation P, and the detector 112 could be provided with an inverse spectral tilt mechanism which would apply the inverse spectral tilt in a known manner to the synthesized TD signal segment $\overline{Z}$ in case the VAD flag indicates active speech. For audio signals that show strong variation in the spectral tilt, this tilt compensation simplifies the spectral modeling following ASCB and FSCB searches.

In an implementation wherein two different encoding modes are available, and wherein different signal segments can be encoded by either one of the encoding modes, waveform and energy matching between the two encoding modes might be desirable to provide smooth transitions between the encoding modes. A switch of signal modeling and of error minimization criteria may give abrupt and perceptually annoying changes in energy, which can be reduced by such waveform and energy matching. Waveform and energy matching can for instance be beneficial when one encoding mode is a waveform matching time domain encoding mode and the other is a spectrum matching transform based encoding mode, or when two different transform based encoding modes are used. For this purpose, the following expression for the global gain $g_{global}$ could provide a balance between the energy and waveform matching:

$$g_{global} = \beta \frac{\sqrt{\sum_{n=0}^{N-1} T^2(n)}}{\sqrt{\sum_{n=o}^{N-1} Z^2(n)}} + (1-\beta)\frac{\sqrt{\sum_{n=0}^{N-1} r(n)Z(n)}}{\sqrt{\sum_{n=0}^{N-1} Z^2(n)}}, \tag{19}$$

where the first term represents the contribution to the global gain from the matching of energies between the two encoding modes, the second term represents the contribution from the waveform matching, and β is a parameter $\beta \epsilon [0,1]$ by which the balance between waveform and energy matching can be tuned. In one implementation, β is adaptive to the properties of the signal segment. The possibility of tuning the balance between waveform and energy matching is particularly useful when the encoding of an audio signal can be performed in two different encoding modes, such that an energy step may occur in transitions between the encoding modes. When one available encoding mode is a phase insensitive encoding mode as discussed above wherein at least part of the phase information is random, and the other encoding mode is a CELP based encoding method, a suitable value of β for encoding of a phase insensitive segment may for example lie in the range of [0.5,0.9], e.g. 0.7, which gives a reasonable energy matching while keeping smooth transitions between phase sensitive (e.g. voiced) and phase insensitive (e.g. unvoiced) segments. Other values of β may alternatively be used. In a case where most of the synthesized phase information is random, the second term of the expression for $g_{global}$ will typically be close to zero and could be neglected. So for the case of all-random phase, the expression in (19) can be simplified to a constant attenuation of the signal energy using the constant factor β. Such energy attenuation reflects that the spectrum matching typically yields a better match and hence higher energy than the CELP mode on noise-like segments, and the attenuation serves to even out this energy difference for smoother switching.

The global gain parameter $g_{global}$ is typically quantized to be used by the decoder 112 to scale the decoded signal (for example when determining the synthesized magnitude spectrum according to expressions (8b) or (15b), or, by scaling the synthesized TD signal segment $\overline{Z}$ if, in step 315, the synthesized segment spectrum is determined as $\overline{Y}_{pre}$.)

In an implementation wherein only one encoding mode is available for the encoding of a signal segment, a value of the global gain could for example be determined according to the following expression:

$$g_{global} = \sqrt{\frac{\sum_{k=0}^{M-1} X^2(k)}{\sum_{k=0}^{M-1} Y_{pre}^2(k)}} \tag{20}$$

Figure 12:
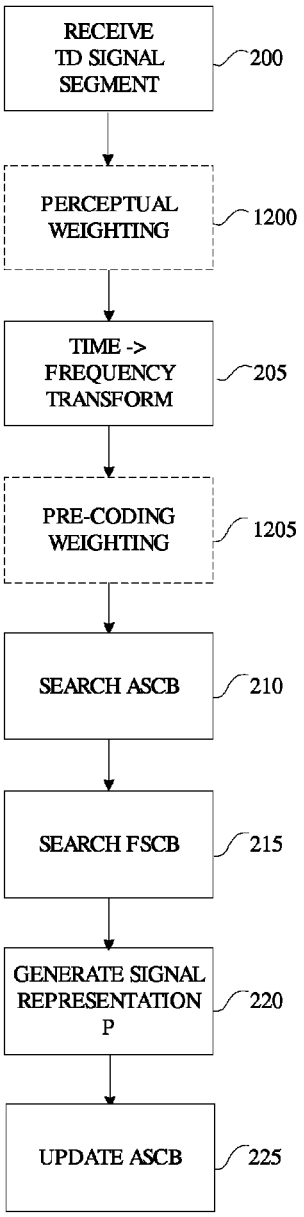
FIG. 12 is a flowchart illustrating an embodiment of the encoding method of FIG. 2.

As mentioned above, the TD signal segment $\overline{T}$ could have been pre-processed prior to entering the encoder 110 (or in another part of the encoder 110, not shown in FIG. 4). Such pre-processing could for example include perceptual weighting of the TD signal segment in a known manner. Perceptual weighting could, as an alternative or in addition to perceptual weighting prior to the t-to-f transform, be applied after the t-to-f transform of step 205. A corresponding inverse perceptual weighting step would then be performed in the decoder 112 prior to applying the f-to-t transform in step 320. A flowchart illustrating a method to be performed in an encoder 110 providing perceptual weighting is shown in FIG. 12. The encoding method of FIG. 12 comprises a perceptual weighting step 1200 which is performed prior to the t-to-f transform step 205. Here, the TD signal segment $\overline{T}$ is transformed to a perceptual domain where the signal properties are emphasized or de-emphasized to correspond to human auditory perception. This step can be made adaptive to the input signal, in which case the parameters of the transformation may need to be encoded to be used by the decoder 112 in a reversed transformation. The perceptual transformation may include one or several steps, e.g. changing the spectral shape of the signal by means of a perceptual filter or changing the frequency resolution by applying frequency warping. Perceptual weighting in known in the art, and will not be discussed in detail. A further, pre-coding weighting step is provided in step 1205, which is entered after the t-to-f transform step 205, prior to the ASCB search in step 220. Both step 1200 and step 1205 are optional—one of them could be included, but not the other, or both, or none of them. Perceptual weighting could also be performed in an optional LP filtering step (not shown). Hence, the perceptual weighting could be applied in combination with an LP-filter, or on its own.

Figure 13:
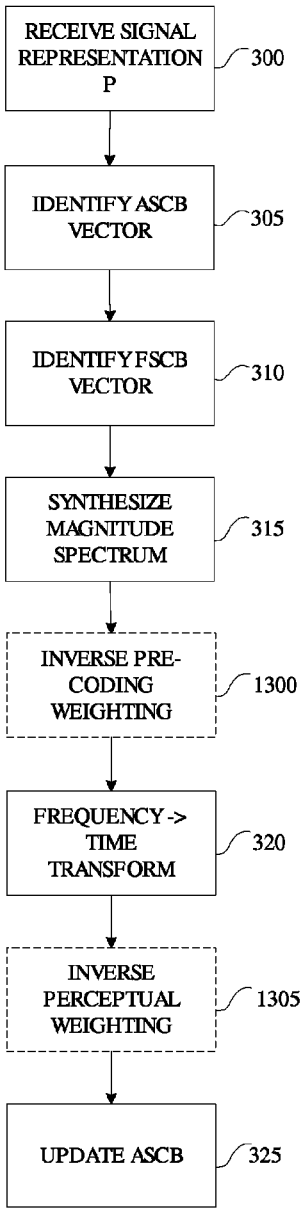
FIG. 13 is a flowchart illustrating an embodiment of the decoding method of FIG. 3.

A flowchart illustrating a corresponding method to be performed in a decoder 110 providing perceptual weighting is shown in FIG. 13. The decoding method of FIG. 13 comprises an inverse pre-coding weighting step 1300 which is performed prior to the f-to-t transform step 320. Here, the synthesized signal spectrum magnitude $\overline{Y}$ is transformed to a perceptual domain where the signal properties are emphasized or de-emphasized to correspond to human auditory perception. The method of FIG. 13 further comprises an inverse perceptual weighting step 1305, performed after the f-to-t transform step 320. If the encoding method includes step 1200, then the decoding method includes step 1305, and if the encoding method includes step 1205, then the decoding method includes step 1300. The application of perceptual weighting will not affect the general method, but will affect which ASCB vectors and FSCB vectors will be selected in steps 210 and 215 of FIG. 2. Preferably, the training of the FSCB 430/525 should take any weighting into account, so that the FSCB 430/525 includes FSCB vectors suitable for an encoding method employing perceptual weighting.

Figure 14:
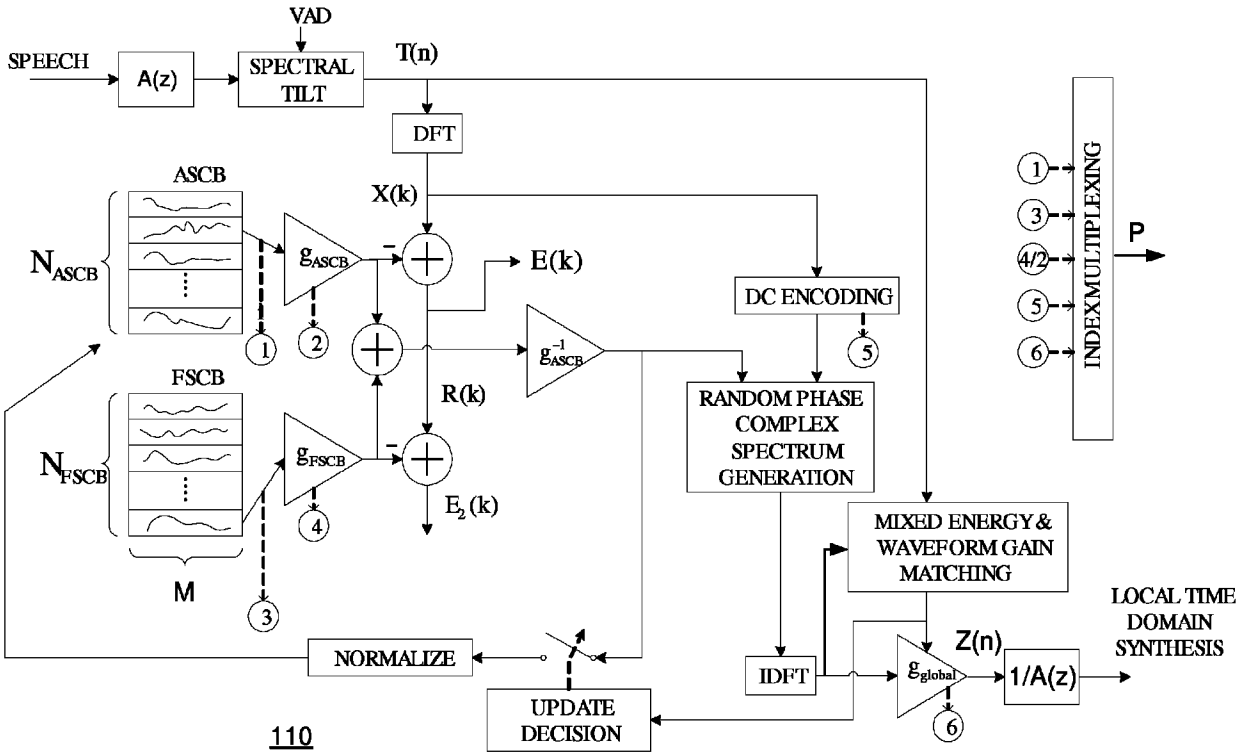
FIG. 14 schematically illustrates an embodiment of an encoder.
Figure 15:
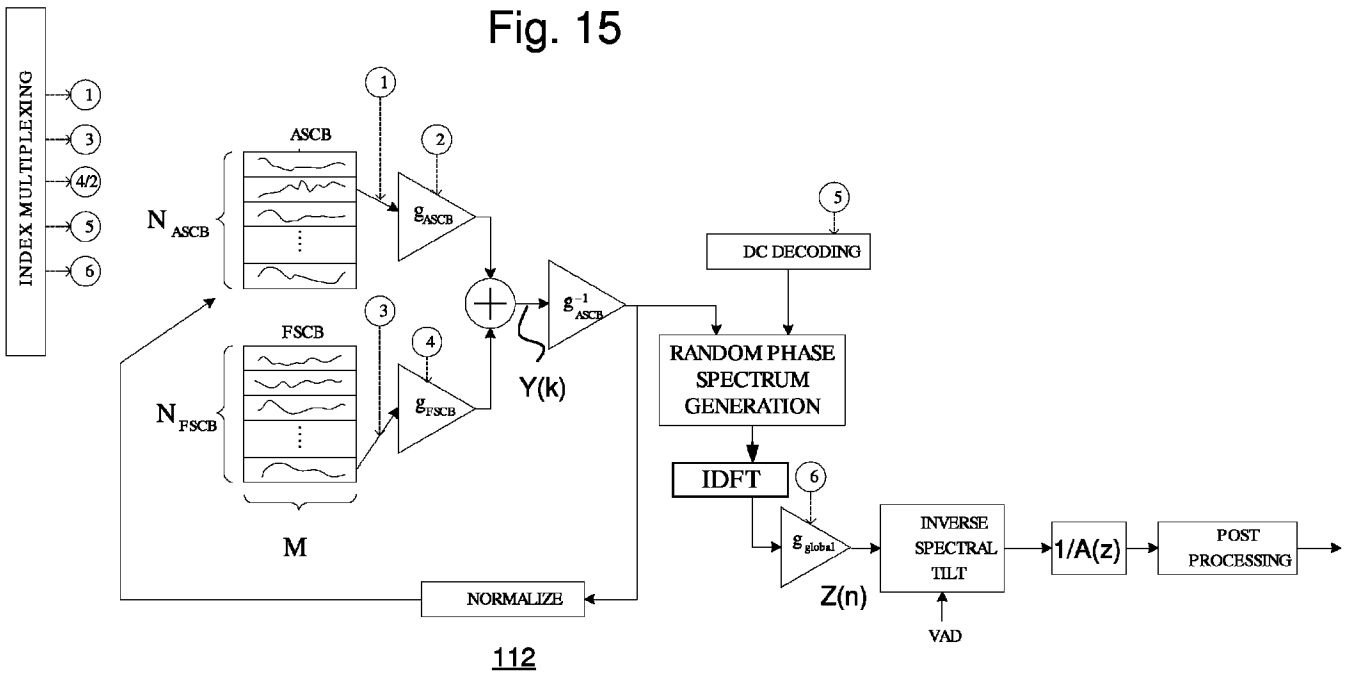
FIG. 15 schematically illustrates an embodiment of a decoder.
Figure 16:
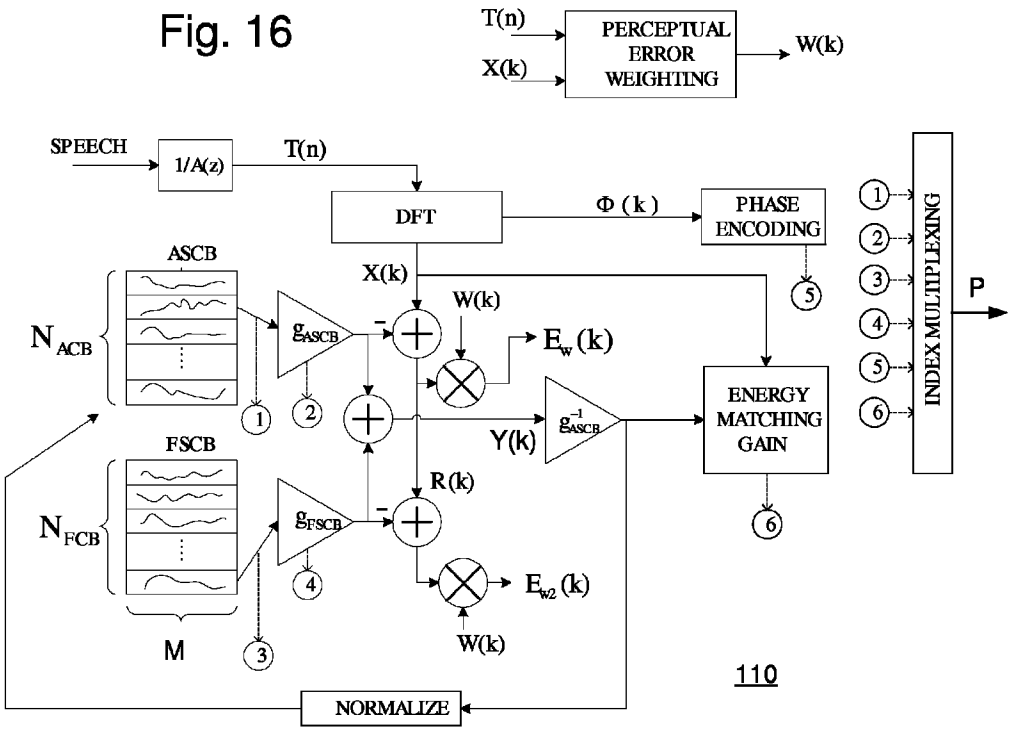
FIG. 16 schematically illustrates an embodiment of an encoder.

In FIGS. 14-16, two different examples of implementations of the above described technology are shown.

In FIG. 14, an example of an implementation of an encoder 110 wherein conditional updating, spectral tilting in dependence on VAD, DC sign encoding, random phase complex spectrum generation and mixed energy and waveform matching is performed on a LP filtered TD signal segment $\overline{T}$ is shown. The signals E(k) and $E_2(k)$ indicate signals to be minimized in the ASCB search and FSCB search, respectively (cf. expressions (3) and (6), respectively). Reference numerals 1-6 indicating the origin of different parameters to be included in the signal representation P, where the reference numerals indicate the following parameters: 1: $i_{ASCB}$; 2: $g_{ASCB}$; 3: $i_{FSCB}$; 4: $g_{FSCB}$; 5: DC±; 6: $g_{global}$.

In FIG. 15, a corresponding decoder 112 is schematically illustrated.

FIG. 16 schematically illustrates an implementation of an encoder 110 wherein phase encoding, pre-coding weighting and energy matching is performed. A perceptual weight W(k) is derived from the TD signal segment T(n) and the magnitude spectrum X(k), and is taken into account in the ASCB search, as well as in the FSCB search, so that signals $E_w(k)$ and $E_{w2}(k)$ are signals to be minimized in the ASCB search and FSCB search, respectively. The energy matching could for example be performed in accordance with expression (20). The encoder 110 of FIG. 16 does not provide any local synthesis. In FIG. 16, reference numerals 1-6 indicate the following parameters: 1: $i_{ASCB}$, 2: $g_{ASCB}$; 3: $i_{FSCB}$, 4: $g_{FSCB}$; 5: $\phi(k)$; 6: $g_{global}$. Here, explicit values of $g_{ASCB}$ and $g_{FSCB}$ are included in P together with a value of $g_{global}$, instead of a value of $g_{global}$ and the gain ratio $g_{\alpha}$, as in the implementation shown in FIG. 14.

The encoder of FIG. 16 is configured to include values of $g_{ASCB}$ & $g_{FSCB}$, as well as a value of $g_{global}$ in the signal representation P, while the encoder of FIG. 14 is configured to include a value of the gain ratio and a value of the global gain in P.

Figure 17:
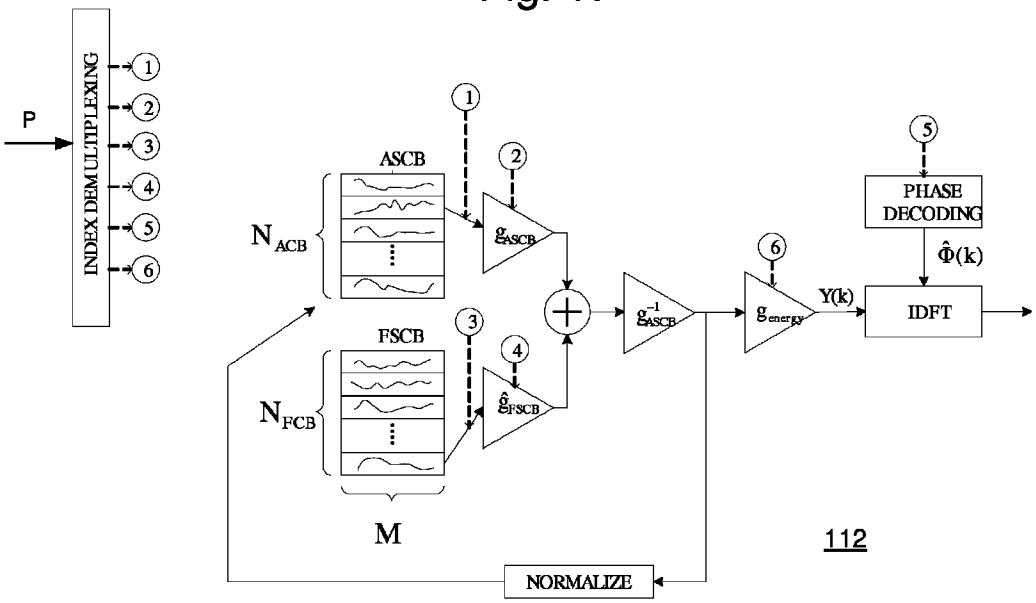
FIG. 17 schematically illustrates an embodiment of a decoder.

FIG. 17 schematically illustrates a decoder 112 arranged to decode a signal representation P received from the encoder 110.

Figure 18:
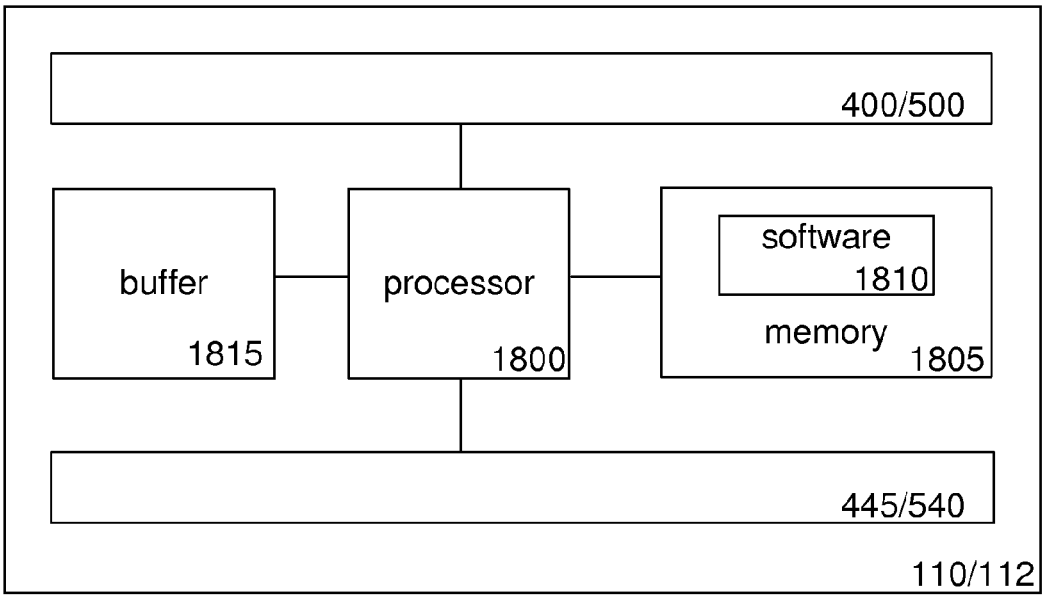
FIG. 18 is an alternative illustration of an encoder or of a decoder.

The encoder 110 and the decoder 112 could be implemented by use of a suitable combination of hardware and software. In FIG. 18, an alternative way of schematically illustrating an encoder 110 is shown (cf. FIGS. 4, 14 and 16). FIG. 18 shows the encoder 110 comprising a processor 1800 connected to a memory 1805, as well as to input 400 and output 445. The memory 1805 comprises computer readable means that stores computer program(s) 1810, which when executed by the processing means 1800 causes the encoder 110 to perform the method illustrated in FIG. 2 (or an embodiment thereof). In other words, the encoder 110 and its mechanisms 405, 410, 420, 425, 435 and 440 may in this embodiment be implemented with the help of corresponding program modules of the computer program 1810. Processor 1800 is further connected to a data buffer 1815, whereby the ASCB 415 is implemented. FSCB 430 is implemented as part of memory 1805, such part for example being a separate memory. An FSCB 525 could for example be stored in a RWM (Read-Write) memory or ROM (Read-Only) memory.

The illustration of FIG. 18 could alternatively represent an alternative way of illustrating a decoder 112 (cf. FIGS. 5, 15 and 17), wherein the decoder 112 comprises a processor 1800, a memory 1805 that stores computer program(s) 1810, which, when executed by the processing means 1800 causes the decoder 112 to perform the method illustrated in FIG. 3 (or an embodiment thereof). In this representation of the decoder, ASCB 515 is implemented by means of data buffer 1815, and FSCB 525 is implemented as part of memory 1805. Hence, the decoder 110 and its mechanisms 505, 510, 520, 530 and 535 may in this embodiment be implemented with the help of corresponding program modules of the computer program 1810.

The processor 1800 could, in an implementation, be one or more physical processors—for example, in the encoder case, one physical processor could be arranged to execute code relating to the t-to-f transform, and another processor could be employed in the ASCB search, etc. The processor could be a single CPU (Central processing unit), or it could comprise two or more processing units. For example, the processor may include general purpose microprocessors, instruction set processors and/or related chips sets and/or special purpose microprocessors such as ASICs (Application Specific Integrated Circuit). The processor may also comprise board memory for caching purposes.

Memory 1805 comprises a computer readable medium on which the computer program modules, as well as the FSCB 525, are stored. The memory 1805 could be any type of non-volatile computer readable memories, such as a hard drive, a flash memory, a CD, a DVD, an EEPROM etc, or a combination of different computer readable memories. The computer program modules described above could in alternative embodiments be distributed on different computer program products in the form of memories within an encoder 110/decoder 112. The buffer 1815 is configured to hold a dynamically updated ASCB 415/515 and could be any type of read/write memory with fast access. In one implementation, the buffer 1815 forms part of memory 1805.

For purposes of illustration only, the above description has been made in terms of the frequency domain representation of a time domain signal segment being a segment spectrum obtained by applying a time-to-frequency transform to the signal segment. However, other ways of obtaining a frequency domain representation of a signal segment may be employed, such as a Linear Prediction (LP) analysis, a Modified Discrete Cosine Transform analysis, or any other frequency analysis, where the term frequency analysis here refers to an analysis which, when performed on a time domain signal segment, yields a frequency domain representation of the signal segment. A typical LP analysis includes calculating of the short-term auto-correlation function from the time domain signal segment and obtaining LP coefficients of an LP filter using the well-known Levinson-Durbin recursion. Examples of an LP analysis and the corresponding time domain synthesis can be found in references describing CELP codecs, e.g. ITU-T G.718 section 6.4. An example of a suitable MDCT analysis and the corresponding time domain synthesis can for example be found in ITU-T G.718 sections 6.11.2 and 7.10.6.

In an implementation wherein another frequency analysis than a time-to-frequency transform is employed, step 205 of the encoding method would be replaced by a step wherein another frequency analysis is performed, yielding another frequency domain representation. Similarly, step 305 would be replaced by a corresponding time domain synthesis based on the frequency domain representation. The remaining steps of the encoding method and decoding method could be performed in accordance with the description given in relation to using a time-to-frequency transform. An ASCB 415 is searched for an ASCB vector providing a first approximation of the frequency domain representation; a residual frequency representation is generated as the difference between the frequency domain representation and the selected ASCB vector, and an FSCB 425 is searched for an FSCB vector which provides an approximation of the residual frequency representation. However, the contents of the FSCBs 425/525, and hence the contents of the ASCB 415/515, could advantageously be adapted to the employed frequency analysis. The result of an LP analysis will be an LP filter. In an implementation wherein the frequency domain representation of a signal segment is obtained by use of an LP analysis, the ASCBs 415/515 would comprise ASCB vectors which could provide an approximation of the LP filter obtained from performing the LP analysis on a signal segment, and the FSCBs 425/525 would comprise FSCB vectors representing differential LP filter candidates, in a manner corresponding to that described above in relation to a frequency domain representation obtained by use of a time-to-frequency transform. Similarly, in an implementation wherein the frequency domain representation of a signal segment is obtained by performing an MDCT analysis on the signal segment, the ASCBs 415/515 would comprise ASCB vectors which could provide an approximation of an MDCT spectrum obtained from performing the MDCT analysis on a signal segment, and the FSCBs 425/525 could comprise FSCB vectors representing differential MDCT spectrum candidates.

When an LP analysis is used as the frequency analysis, the LP filter coefficients obtained from the LP analysis could, if desired, be converted from prediction coefficients to a domain which is more robust for approximations, such as for example an immitance spectral pairs (ISP) domain, (see for example ITU-T G.718 section 6.4.4). Other examples of suitable domains are a Line Spectral Frequency domain (LSF), an Immitance Spectral Frequency (ISF) domain or the Line Spectral Pairs (LSP) domain. Since small approximations on the LP coefficients themselves may lead to a large degradation in the performance of the LP filter, it is often advantageous to perform such conversion of the coefficients into a more robust domain, and the converted representation is used for quantization and interpolation of the LP filter.

The LP filter would in this implementation not provide a phase representation, but the LP filter could be complemented with a time domain excitation signal, representing an approximation of the LP residual. For phase insensitive segments, the time domain excitation signal could be generated with a random generator. For phase sensitive segments, the time domain excitation signal could be encoded with any type of time or frequency domain waveform encoding, e.g. the pulse excitation used in CELP, PCM, ADPCM, MDCT-coding etc. The generation of a synthesized TD signal segment (corresponding to step 320 of FIGS. 3 and 13) from the frequency domain representation would in this case be performed by filtering the time domain excitation signal through the frequency domain representation LP filter.

The above described invention can be for example be applied to the encoding of audio signals in a communications network in both fixed and mobile communications services used for both point-to-point calls or teleconferencing scenarios. In such systems, a user equipment could be equipped with an encoder 110 and/or a decoder 112 as described above. The invention is however also applicable to other audio encoding scenarios, such as audio streaming applications and audio storage.

The advantages of the described technology in terms of improved encoding of noise-like sounds such as fricatives are particularly significant at low bitrates, since it is at the low bit rates that the known encoding methods are particularly weak. However, the technology described herein is applicable to audio encoding at any bit rate.

Although various aspects of the invention are set out in the accompanying independent claims, other aspects of the invention include the combination of any features presented in the above description and/or in the accompanying claims, and not solely the combinations explicitly set out in the accompanying claims.

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

The invention claimed is:

1. A method of encoding an audio signal, the method comprising:

receiving, in an audio encoder, a time domain signal segment originating from the audio signal;

performing, in the audio encoder, a frequency analysis of the time domain signal segment so as to obtain a frequency domain representation of the signal segment;

searching an adaptive spectral code book of the audio encoder for an adaptive spectral code book vector which provides a first approximation of the frequency domain representation, the adaptive spectral code book comprising a plurality of adaptive spectral code book vectors;

selecting the adaptive spectral code book vector providing a first approximation;

generating a residual frequency representation from a difference between the frequency domain representation and the selected adaptive spectral code book vector;

searching a fixed spectral code book of the audio encoder for a fixed spectral code book vector which provides an approximation of the residual frequency representation, the fixed spectral code book comprising a plurality of fixed spectral code book vectors;

selecting the fixed spectral code book vector providing an approximation of the residual frequency representation;

updating the adaptive spectral code book of the audio encoder by including a vector obtained as a linear combination of the selected fixed spectral code book vector and the selected adaptive spectral code book vector; and generating, in the audio encoder, a signal representation of the received time domain signal segment, the signal representation being indicative of an index referring to the selected adaptive spectral code book vector and an index referring to the selected fixed spectral code book vector, the signal representation to be conveyed to a decoder.

2. The encoding method of claim 1, wherein:

the selected adaptive spectral code book vector matches the frequency domain representation in a minimum mean squared error sense to minimize the residual frequency representation; and the selected fixed spectral code book vector matches the residual frequency representation in a minimum mean squared error sense.

3. The encoding method of claim 1, further comprising:

determining, in the audio encoder, a relevance of the linear combination for the encodability of future frequency domain representations;

wherein the updating of the adaptive spectral code book is conditional on the relevance exceeding a predetermined relevance threshold.

4. The encoding method of claim 3, wherein:

the relevance of the linear combination is determined by determining a global gain of the segment; and the updating of the adaptive spectral code book is conditional on the global gain exceeding a global gain threshold.

5. The encoding method of claim 1:

wherein the segment is classified as a phase sensitive segment or a phase insensitive segment;

wherein the encoding of the segment is dependent on whether the segment is classified as phase sensitive or phase insensitive.

6. The encoding method of claim 5:

wherein the segment is a phase insensitive segment;

wherein any further received signal segment that is classified as phase sensitive will be encoded by a time domain based encoding method.

7. The encoding method of claim 5, wherein the signal representation includes more information relating to the result of the performed frequency analysis if the segment is phase sensitive than if the segment is phase insensitive.

8. The encoding method of claim 1:

wherein the frequency analysis is a time-to-frequency domain transform by which a segment spectrum is obtained;

wherein the frequency domain representation is formed from at least a part of the segment spectrum.

9. The encoding method of claim 8:

further comprising identifying, in the audio encoder, a sign of a real valued DC component of the segment spectrum;

wherein the generating of a signal representing the received time domain signal segment is performed such that the signal is indicative of the sign of the DC component.

10. The encoding method of claim 1:

wherein the frequency analysis is a linear prediction analysis;

wherein the frequency domain representation is a linear prediction filter.

11. The encoding method of claim 10:

further comprising determining, in the audio encoder, the phase of the segment spectrum;

wherein the generating of a signal representing the received time domain signal segment is performed such that the signal is indicative of a parameterized representation of at least a part of the phase of the segment spectrum.

12. The encoding method of claim 11:

wherein the segment is classified as a phase sensitive segment or a phase insensitive segment;

wherein the encoding of the segment is dependent on whether the segment is classified as phase sensitive or phase insensitive;

wherein the determining of the phase of the segment spectrum is conditional on the segment having been classified as a phase sensitive segment.

13. The method of claim 1, further comprising;

receiving, in the audio encoder, a further time domain signal segment originating from the audio signal;

performing, in the audio encoder, the frequency analysis of the further time domain signal segment, so as to obtain a further frequency domain representation representing the further time domain signal;

determining whether a quality of a first approximation of the further frequency domain representation provided by any of the adaptive spectral code book vectors would be sufficient, and if not:

searching the fixed spectral code book for at least two further fixed spectral code book vectors, a linear combination of which provides an approximation of the further frequency domain representation, and selecting the at least two further fixed spectral code book vectors;

updating the adaptive spectral code book by including a vector obtained as a linear combination of the at least two further fixed spectral code book vectors; and generating, in the audio encoder, a signal representing the further time domain signal segment and being indicative of further fixed code book indices, each referring to one of the at least two further selected fixed code book vectors.

14. The method of claim 1, wherein the time domain signal segment originates from a segment of the audio signal having been filtered using a linear prediction filter.

15. The method of claim 1, further comprising applying perceptual weighting, in the audio encoder, to the time domain signal segment and/or to the frequency domain representation prior to performing the searching.

16. A method of decoding an audio signal that has been encoded, the method comprising:

receiving, in an audio decoder, a signal representing a time domain signal segment of the audio signal, the representation being indicative of an adaptive spectral code book index and a fixed spectral code book index;

identifying, in an adaptive spectral code book of the audio decoder, an adaptive spectral code book vector to which the adaptive spectral code book index refers, the adaptive spectral code book comprising a plurality of adaptive spectral code book vectors;

identifying, in a fixed spectral code book of the audio decoder, a fixed spectral code book vector to which the fixed spectral code book index refers, the fixed spectral code book comprising a plurality of fixed spectral code book vectors;

generating, in the audio decoder, a synthesized frequency domain representation of the signal segment from a linear combination of the identified fixed spectral code book vector and the identified adaptive spectral code book vector;

generating, in the audio decoder, a synthesized time domain signal segment using the synthesized frequency domain representation;

updating the adaptive spectral code book by including a vector corresponding to a linear combination of the identified adaptive spectral code book vector and the identified fixed spectral code book vector linear combination.

17. The decoding method of claim 16:

further comprising determining, in the audio decoder, a relevance of the linear combination for the encodability of future frequency domain representations;

wherein the updating of the adaptive spectral code book is conditional on the relevance of the linear combination exceeding a predetermined relevance threshold.

18. The decoding method of claim 16, further comprising receiving, in the audio decoder, an indication that the segment to be synthesized is a phase insensitive segment.

19. The decoding method of claim 16:

wherein the frequency domain representation corresponds to a filter applicable in time domain;

wherein the generating of a synthesized time domain signal segment is performed by applying the filter to an excitation signal.

20. The decoding method of claim 16:

wherein the generated synthesized frequency domain representation is a synthesized magnitude spectrum of a segment spectrum;

wherein the generating of a synthesized time domain signal segment is performed by applying a frequency-to-time transform to the segment spectrum.

21. The decoding method of claim 20:

further comprising receiving, in the audio decoder, an indication that the segment to be synthesized is a phase insensitive segment;

determining, in the audio decoder prior to performing the frequency-to-time transform, a pseudo-random phase spectrum by means of a random number generator;

assigning the pseudo-random phase spectrum to the segment spectrum prior to applying the frequency-to-time transform to the segment spectrum.

22. The decoding method of claim 21:

wherein the signal representation further comprises an indication of a sign of a real valued DC component of the segment spectrum;

further comprising assigning, in the decoder, the indicated sign to the real valued DC component of the pseudo random phase spectrum, prior to applying the frequency-to-time transform to the segment spectrum.

23. The decoding method claim 20:

wherein the signal representing the time domain signal segment is indicative of a parameterized representation of at least part of the phase spectrum of the segment spectrum;

further comprising assigning, in the decoder and prior to applying the frequency-to-time transform to the segment spectrum, a phase spectrum to the segment spectrum in accordance with the phase parameterization.

24. The decoding method of claim 20:

wherein the identified adaptive spectral code book vector and the identified fixed spectral code book vector are quantized spectra;

wherein the synthesizing of the segment spectrum includes:

identifying any frequency bins for which a sum of a magnitude of the two code book vectors from which the segment spectrum is synthesized takes a negative value; and setting the magnitude of the segment spectrum to zero for such frequency bins prior to applying the frequency-to-time transform to the segment spectrum.

25. The decoding method of claim 16, further comprising:

receiving, in the audio encoder in relation to the synthesis of a further time domain signal segment, an indication that the further signal segment should be synthesized by means of at least two fixed spectral code book vectors, as well as receiving at least two fixed spectral code book indices;

identifying, in the fixed spectral code book base on the received at least two fixed spectral code book indices, at least two corresponding fixed spectral code book vectors;

generating, in the audio decoder, a further synthesized frequency domain representation from a linear combination of the at least two identified fixed spectral code book indices;

generating, in the audio decoder, a further synthesized time domain signal segment using the further synthesized frequency domain representation;

updating the adaptive spectral code book by including a vector corresponding to the linear combination of the at least two identified fixed spectral code book vectors.

26. An audio encoder for encoding of an audio signal, the encoder comprising:

an input configured to receive a time domain signal segment originating from an audio signal;

an adaptive spectral code book configured to store and update a plurality of adaptive spectral code book vectors;

a fixed spectral code book configured to store a plurality of fixed spectral code book vectors;

a processor connected to the input, the adaptive spectral code book, the fixed spectral code book, and to an output, the processor being configured to:

perform a frequency analysis of a time domain signal segment received at the input in order to arrive at a frequency domain representation of the signal segment;

search the adaptive spectral code book for an adaptive spectral code book vector which can provide a first approximation of a frequency domain representation; and select the adaptive spectral code book vector which can provide the first approximation;

generate a residual frequency representation from a difference between the frequency domain representation and a corresponding selected adaptive spectral code book vector;

search the fixed spectral code book to identify a fixed spectral code book vector which provides an approximation of the residual frequency representation;

generate a synthesized frequency domain representation from a linear combination of an identified fixed spectral code book vector and an identified adaptive spectral code book vector;

update the adaptive spectral code book by storing, a vector corresponding to the linear combination in the adaptive spectral code book; and generate an signal representation of a received time domain signal segment, the signal representation being indicative of an adaptive spectral code book index referring to an identified adaptive spectral code book vector and a fixed spectral code book index referring to an identified fixed spectral code book vector, the signal representation to be conveyed to a decoder;

wherein the output is configured to deliver the signal representation generated by the processor.

27. The audio encoder of claim 26, wherein the processor is further configured to:

determine a relevance of a linear combination for the encodability of future frequency domain representations;

update the adaptive spectral code book with a vector, corresponding to a linear combination of an identified fixed spectral code book vector and an identified adaptive spectral code book vector, only if the determined relevance exceeds a predetermined relevance threshold.

28. The audio encoder of claim 26, wherein the processor is further configured to:

determine whether a received time domain signal segment is a phase sensitive signal segment or a phase insensitive signal segment;

adapt at least a part of the encoding of a time domain signal segment to whether the time domain signal segment is phase sensitive or phase insensitive.

29. The audio encoder of claim 28, wherein the processor is further configured to encode any received phase sensitive time domain signal segment using a time domain based encoding method.

30. The audio encoder of claim 28, wherein the processor is configured to include more information relating to the result of the performed frequency analysis if the segment is phase sensitive than if the segment is phase insensitive.

31. The audio encoder of claim 26, wherein the processor is configured to perform a frequency analysis of a time domain signal segment by performing a linear prediction analysis of the signal segment.

32. The audio encoder of claim 26, wherein the processor is configured to perform a frequency analysis of a time domain signal segment by applying a time-to-frequency transform to the signal segment so that a frequency domain representation is obtained as at least a part of a segment spectrum.

33. The audio encoder of claim 32, wherein the processor is further configured to:

identify a sign of a real valued DC component of a segment spectrum; and generate a signal representation of the received time domain signal segment such that the signal representation is indicative of the sign of the DC component of the segment spectrum representing the time domain signal segment.

34. The audio encoder of claim 32, wherein the processor is further configured to:

determine the phase spectrum of a segment spectrum;

parameterize a determined phase spectrum; and generate of a signal representation of the received time domain signal segment such that the signal representation is indicative of at least a part of a parameterized phase spectrum representing the time domain signal segment.

35. The audio encoder of claim 34, wherein the processor is further configured to parameterize the phase spectrum of a signal segment only if the signal segment is phase sensitive.

36. The audio encoder of claim 26, wherein the processor is further configured to determine whether a quality of the first approximation of a segment spectrum would be sufficient, and if not, search the fixed spectral code book for at least two fixed spectral code book vectors, a linear combination of which provides an approximation of the segment spectrum.

37. An audio decoder for synthesis of an audio signal from a signal representing an encoded audio signal, the decoder comprising:

an input configured to receive a signal representation of a time domain signal segment, the signal including an adaptive spectral code book index and a fixed spectral code book index;

an adaptive spectral code book configured to store a plurality of adaptive spectral code book vectors;

a fixed spectral code book configured to store a plurality of fixed spectral code book vectors;

a processor connected to the input, the adaptive spectral code book, the fixed spectral code book, and to an output, the processor configured to:

identify an adaptive spectral code book vector in the adaptive spectral code book using a received adaptive spectral code book index;

identify a fixed spectral code book vector in the fixed spectral code book using a received fixed spectral code book index;

generate a synthesized frequency domain representation from a linear combination of an identified adaptive spectral code book vector and an identified fixed spectral code book vector;

generate a synthesized time domain signal segment using the synthesized frequency domain representation; and update the adaptive spectral code book by storing, in the adaptive spectral code book, a vector corresponding to the linear combination;

wherein the output is configured to deliver the synthesized time domain signal segment generated by the processor.

38. The audio decoder of claim 37, wherein the processor is further configured to:

determine a relevance of the synthesized frequency domain representation for the encodability of future segment spectra; and update the adaptive spectral code book with a vector, corresponding to a linear combination of the identified adaptive spectral code book vector and the identified fixed spectral code book vector, only if the determined relevance exceeds a predetermined relevance threshold.

39. The audio decoder of claim 37, wherein the processor is further configured to:

retrieve, from a received signal, an indication whether a signal segment is a phase sensitive signal segment or a phase insensitive signal segment;

adapt at least a part of the decoding to whether the time domain signal segment is phase sensitive or phase insensitive.

40. The audio decoder of claim 37:

wherein a frequency domain representation corresponds to a filter applicable in time domain; and wherein the processor is configured to generate a synthesized time domain signal segment by applying the filter to an excitation signal.

41. The audio decoder of claim 37:

wherein the processor is configured to generate a synthesized time domain signal segment by applying a frequency-to-time transform to the synthesized frequency domain representation;

wherein the generated synthesized frequency domain representation is a synthesized magnitude spectrum of a segment spectrum.

42. The audio decoder of claim 41, wherein the processor is further configured to:

retrieve, from a received signal, an indication whether a signal segment is a phase sensitive signal segment or a phase insensitive signal segment;

adapt at least a part of the decoding to whether the time domain signal segment is phase sensitive or phase insensitive;

determine a pseudo-random phase spectrum by means of a random number generator; and assign, prior to applying the frequency-to-time transform to a segment spectrum, a pseudo-random phase spectrum to the segment spectrum if an indication of the signal segment being phase insensitive has been retrieved.

43. The audio decoder of claim 42, wherein the processor is further configured to:

retrieve, from the signal representation, an indication of a sign of a real valued DC component of a segment spectrum; and assign the indicated sign to a real valued DC component of a pseudo random phase spectrum prior to applying the frequency-to-time transform to the segment spectrum.

44. The audio decoder of claim 43, wherein the processor is further configured to:

retrieve, from a received signal representation, an indication of a parameterized representation of at least a part of the phase spectrum of a segment spectrum; and assign a phase spectrum to a segment spectrum in accordance with the phase parameterization prior to applying the frequency-to-time transform to the segment spectrum.

45. A user equipment for communication in a mobile radio communications system, the user equipment comprising an audio encoder comprising:

an input configured to receive a time domain signal segment originating from an audio signal;

an adaptive spectral code book configured to store and update a plurality of adaptive spectral code book vectors;

a fixed spectral code book configured to store a plurality of fixed spectral code book vectors;

a processor connected to the input, the adaptive spectral code book, the fixed spectral code book, and to an output, the processor being configured to:

perform a frequency analysis of a time domain signal segment received at the input in order to arrive at a frequency domain representation of the signal segment;

search the adaptive spectral code book for an adaptive spectral code book vector which can provide a first approximation of a frequency domain representation; and select the adaptive spectral code book vector which can provide the first approximation;

generate a residual frequency representation from a difference between the frequency domain representation and a corresponding selected adaptive spectral code book vector;

search the fixed spectral code book to identify a fixed spectral code book vector which provides an approximation of the residual frequency representation;

generate a synthesized frequency domain representation from a linear combination of an identified fixed spectral code book vector and an identified adaptive spectral code book vector;

update the adaptive spectral code book by storing, a vector corresponding to the linear combination in the adaptive spectral code book; and generate an signal representation of a received time domain signal segment, the signal representation being indicative of an adaptive spectral code book index referring to an identified adaptive spectral code book vector and a fixed spectral code book index referring to an identified fixed spectral code book vector, the signal representation to be conveyed to a decoder;

wherein the output is configured to deliver the signal representation generated by the processor.

46. A user equipment for communication in a mobile radio communications system, the user equipment comprising an audio decoder comprising:

an input configured to receive a signal representation of a time domain signal segment, the signal including an adaptive spectral code book index and a fixed spectral code book index;

an adaptive spectral code book configured to store a plurality of adaptive spectral code book vectors;

a fixed spectral code book configured to store a plurality of fixed spectral code book vectors;

a processor connected to the input, the adaptive spectral code book, the fixed spectral code book, and to an output, the processor configured to:

identify an adaptive spectral code book vector in the adaptive spectral code book using a received adaptive spectral code book index;

identify a fixed spectral code book vector in the fixed spectral code book using a received fixed spectral code book index;

generate a synthesized frequency domain representation from a linear combination of an identified adaptive spectral code book vector and an identified fixed spectral code book vector;

generate a synthesized time domain signal segment using the synthesized frequency domain representation; and update the adaptive spectral code book by storing, in the adaptive spectral code book, a vector corresponding to the linear combination;

wherein the output is configured to deliver the synthesized time domain signal segment generated by the processor.

47. A computer program product stored in a non-transitory computer readable medium for encoding an audio signal, the computer program product comprising software instructions which, when run on a processor of an encoder, causes the encoder to:

perform a frequency analysis of a time domain signal segment in order to arrive at a frequency domain representation of the signal segment;

search an adaptive spectral code book for an adaptive spectral code book vector which can provide a first approximation of the frequency domain representation, and to select the adaptive spectral code book vector which can provide the first approximation;

generate a residual frequency representation from a difference between the frequency domain representation and the selected adaptive spectral code book vector;

search the fixed spectral code book to identify a fixed spectral code book vector which provides an approximation of a residual frequency representation;

update the adaptive spectral code book by including a vector obtained as a linear combination of the selected fixed spectral code book vector and the selected adaptive spectral code book vector; and generate a signal representation of the time domain signal segment, the signal representation being indicative of an index referring to the identified adaptive spectral code book vector and an index referring to the identified fixed spectral code book vector, the signal representation to be conveyed to a decoder.

48. A computer program product stored in a non-transitory computer readable medium for decoding an audio signal, the computer program product comprising software instructions which, when run on a processor of an decoder, causes the decoder to:

retrieve, from a received signal representation representing a time domain signal segment of the audio signal, an adaptive spectral code book index and a fixed spectral code book index;

identify, based on the retrieved adaptive spectral code book, index an adaptive spectral code book vector in an adaptive spectral code book;

identify, based on the retrieved fixed spectral code book index, a fixed spectral code book vector in a fixed spectral code book;

generate a synthesized frequency domain representation of the signal segment from a linear combination of the identified adaptive spectral code book vector and the identified fixed spectral code book vector;

generate a synthesized time domain signal segment using the synthesized frequency domain representation; and update the adaptive spectral code book by including a vector corresponding to a linear combination of the identified adaptive spectral code book vector and the identified fixed spectral code book vector.

* * * * *